US005733174A

United States Patent [19]

Bingham et al.

[11] Patent Number: 5,733,174

[45] Date of Patent: Mar. 31, 1998

[54] METHOD AND APPARATUS FOR CUTTING, ABRADING, AND DRILLING WITH SUBLIMABLE PARTICLES AND VAPOROUS LIQUIDS

[75] Inventors: Dennis N. Bingham, Idaho Falls; Richard C. Swainston; Gary L. Palmer, both of Shelley, all of Id.

[73] Assignee: Lockheed Idaho Technologies Company, Idaho Falls, Id.

[21] Appl. No.: 513,709

[22] Filed: Aug. 11, 1995

Related U.S. Application Data

[63] Continuation-in-part of Ser. No. 178,533, Jan. 7, 1994, Pat. No. 5,456,629.

[51] Int. Cl.[6] ..... B24B 1/00; B24C 1/00

[52] U.S. Cl. ..... 451/39; 451/102; 451/75

[58] Field of Search ..... 451/75, 102, 39, 451/53, 38, 40, 343, 353, 100, 90, 89, 99; 134/7; 241/39

[56] References Cited

U.S. PATENT DOCUMENTS

| | | | |
|---|---|---|---|
| 4,038,786 | 8/1977 | Fong | 451/39 |
| 4,389,820 | 6/1983 | Fong et al. | 451/75 |
| 5,018,667 | 5/1991 | Lloyd | 451/39 |
| 5,062,898 | 11/1991 | McDermott et al. | 134/7 |
| 5,065,551 | 11/1991 | Fraser | 451/75 |
| 5,203,794 | 4/1993 | Stratford et al. | 451/53 |
| 5,283,989 | 2/1994 | Hisasue et al. | 451/75 |
| 5,294,261 | 3/1994 | McDermott et al. | 134/7 |
| 5,341,608 | 8/1994 | Mains, Jr. | 451/53 |
| 5,390,450 | 2/1995 | Goenka | 451/75 |
| 5,405,283 | 4/1995 | Goenka | 451/40 |
| 5,445,553 | 8/1995 | Cryer et al. | 451/40 |
| 5,514,024 | 5/1996 | Goenka | 451/53 |

*Primary Examiner*—James G. Smith
*Assistant Examiner*—Derris H. Banks
*Attorney, Agent, or Firm*—Klaas Law O'Meara & Matkin

[57] ABSTRACT

A gas delivery system provides a first gas which is in a liquid state under extreme pressure and in a gaseous state under intermediate pressure. A particle delivery system provides a slurry comprising the first gas in a liquid state and a second gas in a solid state. The second gas is selected so that it will solidify at a temperature at or above the temperature of the first gas in a liquid state. A nozzle assembly connected to the gas delivery system and to the particle delivery system produces a stream having a high velocity central jet comprising the slurry, a liquid sheath surrounding the central jet comprising the first gas in a liquid state and an outer jacket surrounding the liquid sheath comprising the first gas in a gas state.

29 Claims, 17 Drawing Sheets

215

METHOD AND APPARATUS FOR CUTTING, ABRADING, AND DRILLING WITH SUBLIMABLE PARTICLES AND VAPOROUS LIQUIDS

CROSS-REFERENCE TO RELATED APPLICATION

This application is a continuation-in-part of U.S. application, Ser. No. 08/178,533, filed on January 7, 1994, which is now U.S. Pat. No. 5,456,629.

CONTRACTUAL ORIGIN OF THE INVENTION

The United States Government has rights in this invention pursuant to Contract No. DE-AC07-94ID13223 between the U.S. Department of Energy and Lockheed Idaho Technologies Company.

FIELD OF THE INVENTION

This invention relates to sandblasting machines in general and more specifically to a method and apparatus for cutting and abrading with sublimable particles.

BACKGROUND OF THE INVENTION

Sandblasting is a generic term used to designate any of a series of processes in which small particles are propelled against a surface to effect changes at or on that surface. For example, sandblasting is commonly used to remove unwanted materials from the surfaces of objects by abrasion or erosion. However, sandblasting techniques have also been developed which can alter the physical condition of the surface of the object, such as by shot peening. Another technique for abrading materials is to use a high velocity water jet to achieve the desired surface treatment. Water jets can also be used to cut certain materials, much like a saw.

Unfortunately, however, both sandblasting and water jet technologies are not without their drawbacks. For example, sandblasting suffers from problems relating to the clean-up and removal of the abrasive particles after they have been used. Dust generation and atmospheric contamination are also problems that must be addressed. Likewise, water jet technology suffers from problems relating to the collection of the water released during the cutting or abrading operation, as well as problems relating to the possible contamination of the water from the eroded material.

Some of the foregoing problems have been solved by sandblasting devices that utilize sublimable particles, such as dry ice, as the abrasive material. The primary advantage of using sublimable particles (i.e., particles that change directly from a solid to a gas without a transition through the liquid state) in a sandblasting operation is that there is no secondary waste material to be collected: The dry ice particles change to gaseous carbon dioxide ($CO_2$) shortly after striking the surface of the object. The gaseous carbon dioxide can then be discharged into the atmosphere. Since carbon dioxide is present in the atmosphere in substantial quantities, venting the carbon dioxide gas into the atmosphere generally does not pose any problems.

The advantages associated with carbon dioxide sandblasting have made it a particularly useful process for decontaminating objects that were previously exposed to radioactive environments. In the typical decontamination process, the dry ice particles propelled against the object will penetrate the contaminated surface layer on the object and blast it away. Since the dry ice particles disappear due to sublimation, the remaining residue consists solely of the contaminated particles that were blasted from the surface of the object. In most cases, the remaining residue can then be easily collected and disposed of as waste, while the previously contaminated object can usually be recycled or disposed of in a conventional manner.

While such carbon dioxide, or dry ice, sandblasting has proven to be very beneficial, particularly in the area of treating hazardous materials, dry ice sandblasting is not a panacea, and many problems remain to be solved. For example, a common problem affecting most dry ice sandblasting devices relates to the creation and handling of the dry ice particles. After formation, the particles tend to agglomerate or clump together in the feed apparatus, thus creating feed problems and making it difficult to achieve a uniform distribution of particles within the blast stream. Furthermore, if the dry ice particles are not immediately injected into the nozzle, particle erosion due to sublimation tends to round off or smooth the sharp corners and edges of the particles, thus reducing their abrasiveness. Existing systems also tend to suffer from low particle densities, which further reduces effectiveness.

Fong in U.S. Pat. No. 4,038,786, attempts to solve some of these problems by using a hopper with a mechanical agitator and an anti-static device to minimize the tendency of the dry ice particles to clump together. Fong also uses a special nozzle and feed system in an attempt to improve the uniformity of the particle stream. Unfortunately, however, Fong's system suffers from other disadvantages, including insufficient particle velocity, non-uniformity and breaking of the dry ice particles, back-up and insufficient feed of particles into the gas stream and freezing occurring in the area of the feed mechanism and nozzle.

Recognizing the shortcomings of his earlier invention, Fong et al. developed an improved system, which is disclosed in U.S. Pat. No. 4,389,820. The improved system is considerably more complex and includes a special pelletizer, rotary airlock, and nozzle, all of which were added in an attempt to solve some of the problems associated with his earlier invention. For example, the pelletizer includes special anti-static devices to help prevent clumping of the particles, while the rotary airlock represents an attempt to provide a more uniform supply of dry ice pellets to the nozzle. The special nozzle has a long and gradual taper to help accelerate the dry ice particles to higher velocities. Unfortunately, however, Fong's improved system is relatively complex and still tends to suffer from many of the problems typically associated with dry ice sandblasting, including particle degradation due to pre-blast sublimation, nozzle mixing problems, and particle storage and feed problems, just to name a few.

Consequently, there remains a need for a blasting device utilizing sublimable particles that can produce a high density, high velocity particle stream to maximize blasting effectiveness, yet maintain a uniform particle stream to ensure consistent and uniform surface treatment. Additional increases in blasting effectiveness could be achieved by reducing, or even eliminating, particle degradation due to pre-blast sublimation of the particles. Ideally, such a device would also eliminate the dry ice agglomeration problem, with all its associated disadvantages. Finally, additional utility could be realized if the device produced a small, high velocity particle stream capable of cutting a wide variety of materials.

SUMMARY OF THE INVENTION

Accordingly, it is a general object of this invention to provide a method and apparatus for cutting and abrading with sublimable particles.

Another object of the invention is to achieve a more uniform and consistent surface treatment.

It is a further object to increase the density of sublimable particles in the particle stream.

Yet another object of this invention is to provide a high velocity particle stream.

It is a yet a further object to provide a more uniform distribution of particles entrained in the stream.

Still another object of this invention is to minimize particle degradation due to pre-blast sublimation of the particles.

It is still yet a further object to provide a particle stream capable of cutting a wide variety of materials.

Additional objects, advantages, and novel features of this invention shall be set forth in part in the description that follows, and in part will become apparent to those skilled in the art upon examination of the following or may be learned by the practice of the invention. The objects and the advantages of the invention may be realized and attained by means of the instrumentalities and in combinations particularly pointed out in the appended claims.

To achieve the foregoing and other objects and in accordance with the purposes of the present invention, as embodied and broadly described herein, the apparatus for cutting and abrading with sublimable particles according to this invention may comprise a gas delivery system for providing a first gas which is in a liquid state under extreme pressure and in a gaseous state under intermediate pressure. A particle delivery system provides a slurry comprising the first gas in a liquid state and a second gas in a solid state. The second gas is selected so that it will solidify at a temperature at or above the temperature of the first gas in a liquid state. A nozzle assembly connected to the gas delivery system and to the particle delivery system produces a stream having a high velocity central jet comprising the slurry, a liquid sheath surrounding the central jet comprising the first gas in a liquid state and an outer jacket surrounding the liquid sheath comprising the first gas in a gas state.

One embodiment of the nozzle may include two nozzles positioned in tandem and moveable with respect to one another. The first or primary nozzle may comprise an elongate nozzle having an inlet end and a tapered outlet end. The second nozzle includes a converging inlet end that is adapted to receive a portion of the primary nozzle so that an annular passage is created between the inlet end of the second nozzle and the primary nozzle. The tapered end of the primary nozzle is aligned with the converging inlet end of the second nozzle so that an annular gap is created therebetween. An adjusting device connected to the first nozzle moves the tapered end of the first nozzle toward and away from the converging inlet end of the second nozzle to change the size of the annular gap therebetween.

Another embodiment of a nozzle may include a cyclone mixing chamber having an inlet end and an outlet end oriented along a flow axis and having a central bore therethrough. The central bore of the cyclone mixing chamber also includes a tangential injection port. A first nozzle having an inlet end and an outlet end is positioned with respect to the cyclone mixing chamber so that the outlet end of the first nozzle is adjacent the inlet end of the cyclone mixing chamber. A second nozzle having an inlet end and an outlet end is positioned with respect to the cyclone mixing chamber so that the inlet end of the second nozzle is adjacent the outlet end of the cyclone mixing chamber.

A rotatable fluid coupling may be used with the nozzles that comprises a main body having a central bore therethrough and an injection chamber that is fluidically connected to the central bore. An elongate tube having a central bore and a transverse bore intersecting the central bore is positioned within the central bore of the main body so that the transverse bore of the elongate tube is in fluid communication with the injection chamber in the main body. First and second sealing devices mounted to the main body are rotatably sealably associated with the central bore in the main body and the elongate tube to prevent fluid within the injection chamber from leaking past the elongate tube.

The slurry may be produced by a particle generator comprising a reservoir for holding a supply of the first liquefied gas at a first temperature and a pressure vessel partially submerged within the supply of the first liquefied gas. The pressure vessel contains an inlet for receiving the liquefied first gas and a spray nozzle for receiving the second gas. The liquefied first gas within the pressure vessel freezes the second gas and forms a slurry that is collected and withdrawn from the pressure vessel.

The liquefied first gas may be pressurized to extreme pressure by a pressurization system comprising a first reciprocating high pressure pump and a second reciprocating high pressure pump. The first and second pumps are operated so that the first reciprocating high pressure pump is placed in a stalled mode and the second high pressure pump is placed in a catch-up mode if the pressure of the liquefied gas at the outlet of the first pump exceeds a predetermined pressure. Similarly, the first pump is operated in a catch-up mode and the second pump placed in a stalled mode if the pressure of the liquefied gas at the outlet of the second pump exceeds the predetermined pressure.

The method of cutting and abrading with sublimable particles according to the present invention includes the steps of: Creating a high velocity jet of slurry by passing a slurry through a first nozzle; directing the high velocity jet of slurry through a second nozzle; passing a liquefied gas through the inlet of the second nozzle so that the liquefied gas comes in contact with the high velocity jet of slurry, the liquefied gas forming a liquid sheath adjacent the high velocity jet of slurry; directing the high velocity jet of slurry and liquid sheath from the second nozzle into a third nozzle; and passing a supply of first gas in vapor form through the inlet of the third nozzle so that the first gas in vapor form flows around the liquid sheath in order to form a jacket around the liquid sheath.

BRIEF DESCRIPTION OF THE DRAWINGS

The accompanying drawings, which are incorporated herein and form a part of the specification illustrate preferred embodiments of the present invention, and together with the description, serve to explain the principles of the invention. In the drawings.

DETAILED DESCRIPTION OF THE INVENTION

Figure 1:
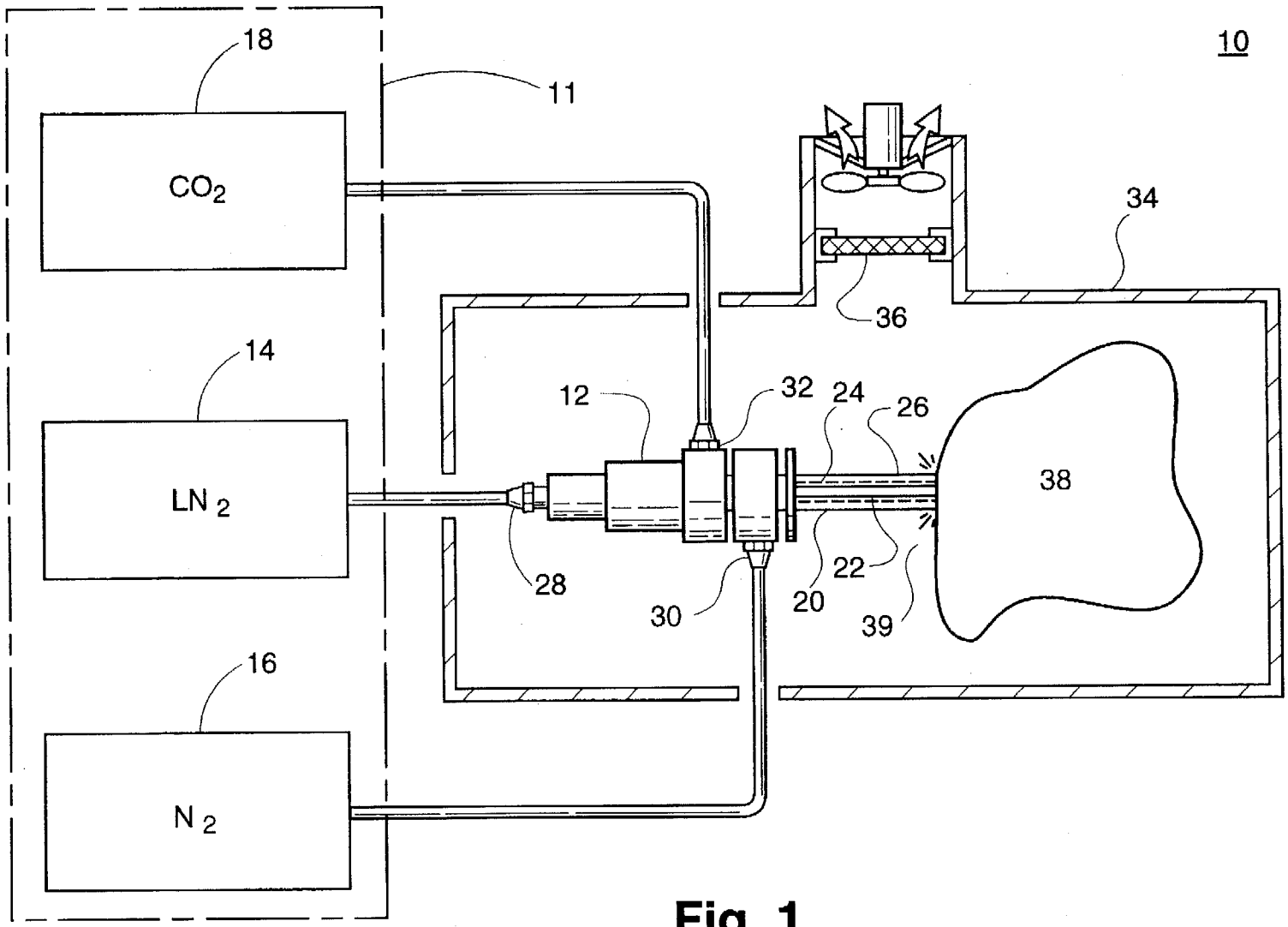
FIG. 1 is a block schematic diagram of the system for cutting and abrading with sublimable particles according to the present invention.

The cutting and abrading system 10 according to the present invention is shown in FIG. 1 and includes a fluid delivery system 11 for delivering liquid nitrogen, gaseous nitrogen, and gaseous carbon dioxide under various pressures to a tri-state nozzle assembly 12. More specifically, the fluid delivery system 11 includes a liquid nitrogen subsystem 14, a gaseous nitrogen subsystem 16, and a gaseous carbon dioxide subsystem 18. As will be described in greater detail below, the tri-state nozzle assembly 12 produces a stream 20 (shown enlarged in FIG. 1 for clarity) having a high velocity liquid nitrogen jet 22 surrounded by a particle sheath 24 of solid carbon dioxide particles (dry ice). A high velocity gaseous nitrogen outer jacket 26 surrounds the carbon dioxide particle sheath 24 and is concentric with both the high velocity liquid nitrogen jet 22 and particle sheath 24. The stream 20 produced by the nozzle assembly 12 thus includes materials in the liquid, solid, and gas states, hence the term "tri-state." In the preferred embodiment, the nozzle assembly 12 and object 38 being treated are enclosed by a waste collection subsystem 34 which collects the nitrogen and carbon dioxide gases, vaporizes any remaining liquid nitrogen or dry ice particles, and discharges these materials into the atmosphere through a high efficiency particulate air filter 36. The waste collection subsystem 34 may also include a device (not shown) for collecting and removing material 39 abraded from the object 38.

A significant advantage of the cutting and abrading system 10 according to the present invention is that it achieves a high density, high velocity, uniform particle stream to maximize blasting effectiveness and to ensure more consistent and uniform surface treatment. Also, while the high velocity particle stream 20 can be used to erode the surface of an object, as in conventional sandblasting operations, it can also be used to cut a wide variety of materials if the stream 20 is maintained in a perpendicular orientation relative to the object surface.

Another advantage of the present invention is that since the carbon dioxide particles are formed within the nozzle assembly 12 itself and remain in intimate contact with the high velocity liquid nitrogen jet 22, loss of particle abrasiveness due to erosion by sublimation is minimized, if not eliminated entirely.

Additional advantages result from the use of carbon dioxide gas to form the dry ice particles within the nozzle assembly 12 itself. For example, since the carbon dioxide gas solidifies upon contact with the high velocity liquid nitrogen jet 22, the present invention can achieve higher particle densities and velocities. Also, it is much easier to achieve uniform dry ice particle entrainment within the stream. Of course, the use of carbon dioxide gas also eliminates the need for apparatus to first solidify the gas then feed the solid carbon dioxide particles to the nozzle. Consequently, the present invention does not encounter problems relating to particle agglomeration, particle feed discontinuities, and non-uniformity and breaking of particles.

Figure 2:
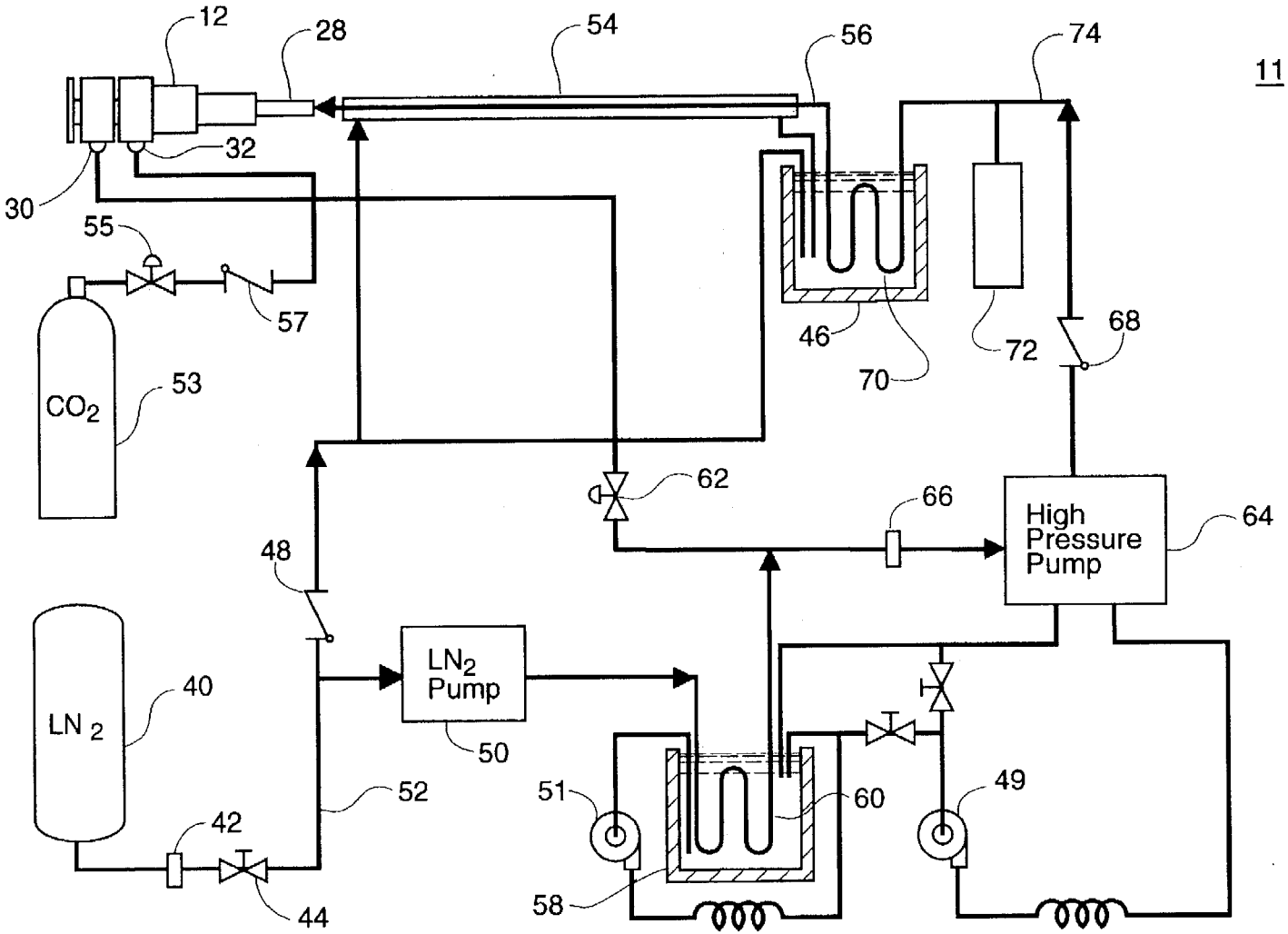
FIG. 2 is a detailed schematic diagram of the cutting and abrading system shown in FIG. 1, showing one possible configuration of the liquid nitrogen, gaseous nitrogen, and gaseous carbon dioxide delivery systems.

Before proceeding with a detailed description of the present invention, it should be noted that the three fluid delivery subsystems 14, 16, and 18 shown in FIG. 1 are integrated into a single, combined fluid delivery system 11 in the embodiment shown in FIG. 2. Therefore, instead of separately describing the three individual subsystems 14, 16, and 18 shown in FIG. 1, the following description is directed to the entire fluid delivery system 11 as an integrated unit.

It should also be noted that FIG. 2 only shows those fluid devices in the fluid delivery system 11 that are necessary to provide an enabling disclosure. FIG. 2 does not show, nor does the following description describe, other components, such as additional pressure regulators, check valves, filters, or compressor cooling systems, etc., that would be generic to such fluid delivery systems or that may be required for certain installations. Since systems for delivering pressurized gases and cryogenic liquids have existed for decades and are well known, it would be obvious to persons having ordinary skill in the art to add to the system shown and described herein those additional components that may be necessary or desirable for a specific installation.

Referring now to FIG. 2, both the liquid and gaseous nitrogen delivered to the nozzle assembly 12 originate from a single liquid nitrogen supply tank 40. After passing through a strainer 42 and valve assembly 44, a portion of the liquid nitrogen from tank 40 is drawn off and compressed to a pressure of about 6,000 pounds per square inch gauge (psig) by a liquid nitrogen pump 50 connected to supply line 52. As will be described in more detail below, the pressurized liquid nitrogen from pump 50 will ultimately be vaporized and a portion injected into the nozzle assembly 12 to form the high velocity gaseous nitrogen outer jacket 26 (FIG. 1). The remaining vaporized nitrogen will be compressed to an even higher pressure, liquefied, and injected into the nozzle assembly 12 to form the high velocity liquid nitrogen jet 22. A portion of the liquid nitrogen from tank 40 is also diverted to a reverse flow cooling jacket 54 surrounding high pressure liquid nitrogen line 56 to keep the high pressure liquid nitrogen from boiling before it reaches the nozzle assembly 12. The liquid nitrogen from the reverse flow cooling jacket 54 is then discharged into a liquid nitrogen bath 46, the level of which is primarily maintained by liquid nitrogen from tank 40 flowing through a check valve 48. As will be described in more detail below, the liquid nitrogen in bath 46 is used to cool and liquefy the high pressure nitrogen gas from high pressure pump 64.

After being compressed by pump 50, the high pressure liquid nitrogen is gassified and warmed to a temperature of about −30° F. by passing it through a heat exchanger 60 in a warming bath 58. In the preferred embodiment, the warming bath 58 is filled with a glycol-water mix that is maintained at a temperature of about −20° F. by a pump and heat exchanger assembly 51.

A portion of the gaseous nitrogen from the heat exchanger 60 is injected into the nitrogen inlet 30 in nozzle assembly 12 and forms the high velocity gaseous nitrogen outer jacket 26 of stream 20 (FIG. 1). To achieve the desired velocity of about 3,000 feet per second, the gaseous nitrogen must be injected into the nozzle assembly 12 under considerable pressure. In the preferred embodiment, a pressure regulating valve 62 is used to regulate the pressure of the gaseous nitrogen to about 6,000 psig. However, gaseous nitrogen pressures anywhere from 0 psig to 6,000 psig may be used depending on the desired characteristics of the stream 20. For example, if no gaseous nitrogen is injected, the liquid nitrogen jet 22 and particle sheath 24 will tend to feather, which may be desirable for certain operations.

The liquid nitrogen for the high velocity liquid nitrogen jet 22 originates from a high pressure intensifier pump 64, which draws off some of the nitrogen gas from the heat exchanger 60 via inlet filter 66. In the preferred embodiment, the high pressure intensifier pump 64 compresses the nitrogen gas to a pressure of about 60,000 psig, although pressures in the range of about 30,000 to 70,000 psig can be used depending on the desired velocity of the particle stream. Optionally, a cooling system 49 for the high pressure pump 64 may be integrated with heat exchanger assembly 51 as a convenient means for rejecting waste heat from pump 64 and for maintaining the warming bath 58 at the desired temperature.

The highly pressurized nitrogen gas from pump 64 passes through a check valve 68 before entering a heat exchanger 70 in cooling bath 46. As briefly described above, cooling bath 46 liquefies the pressurized nitrogen gas and cools it to a temperature of about −240° F. The cooled, liquefied nitrogen gas, still under a pressure of about 60,000 psig, is then injected into the liquid nitrogen inlet 28 of nozzle assembly 12 via inlet line 56. Finally, an accumulator 72 connected to high pressure nitrogen line 74 helps to remove pressure variations from the pump 64.

Gaseous carbon dioxide is fed into the carbon dioxide inlet 32 of tri-state nozzle assembly 12 from a carbon dioxide tank 53 via a pressure regulating valve 55 and check valve 57. In the preferred embodiment, the gaseous carbon dioxide is delivered to the nozzle assembly 12 at a pressure in the range of about 20 psig to 800 psig. However, carbon dioxide delivery pressures in the range of about 20 to 2,000 psig will produce satisfactory results. The gaseous carbon dioxide can be delivered over a wide range of pressures depending on the stream characteristics desired. For example, low carbon dioxide delivery pressures generally produce a relatively thin particle sheath 24 (FIG. 1), resulting in light to moderate abrasive action. Higher delivery pressures generally produce a thicker particle sheath 24, with the particles possibly entrained even deeper within the high velocity liquid nitrogen jet 22 (FIG. 1), thus resulting in greater abrasive action. Therefore, it may be desirable or appropriate to vary the carbon dioxide delivery pressure depending on the nature of the material being abraded or on the particular abrasive action desired.

Figure 3:
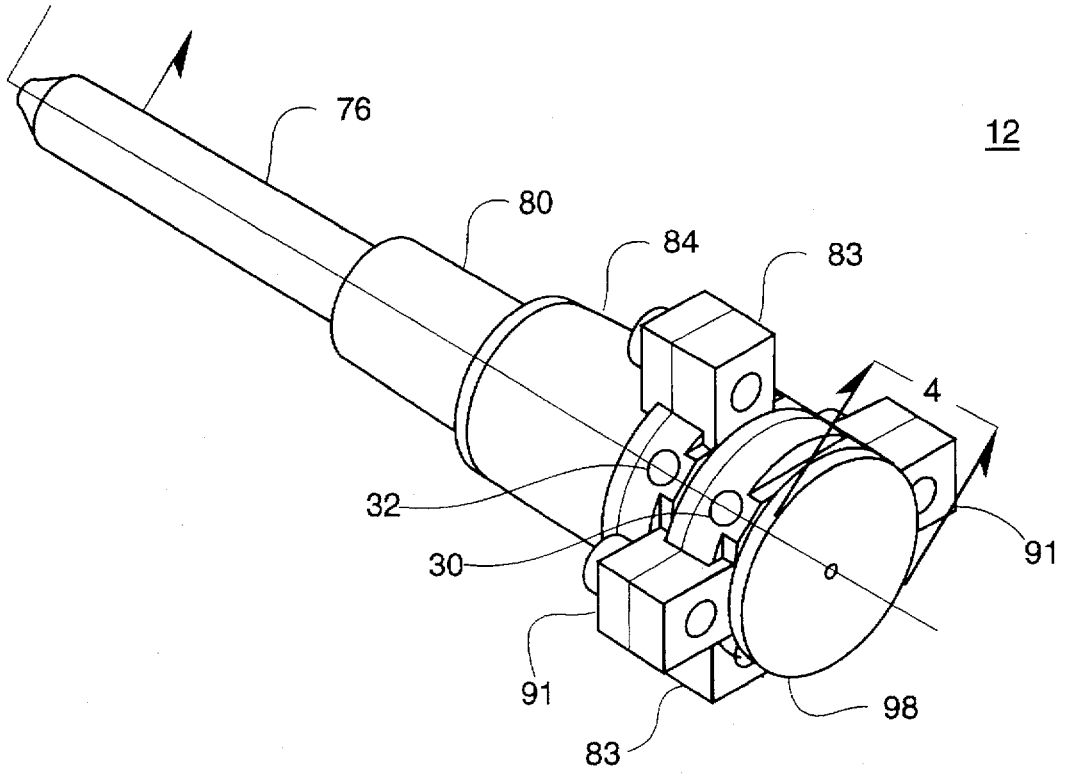
FIG. 3 is a perspective view of a continuous flow tri-state nozzle assembly used in the system of FIG. 1.
Figure 4:
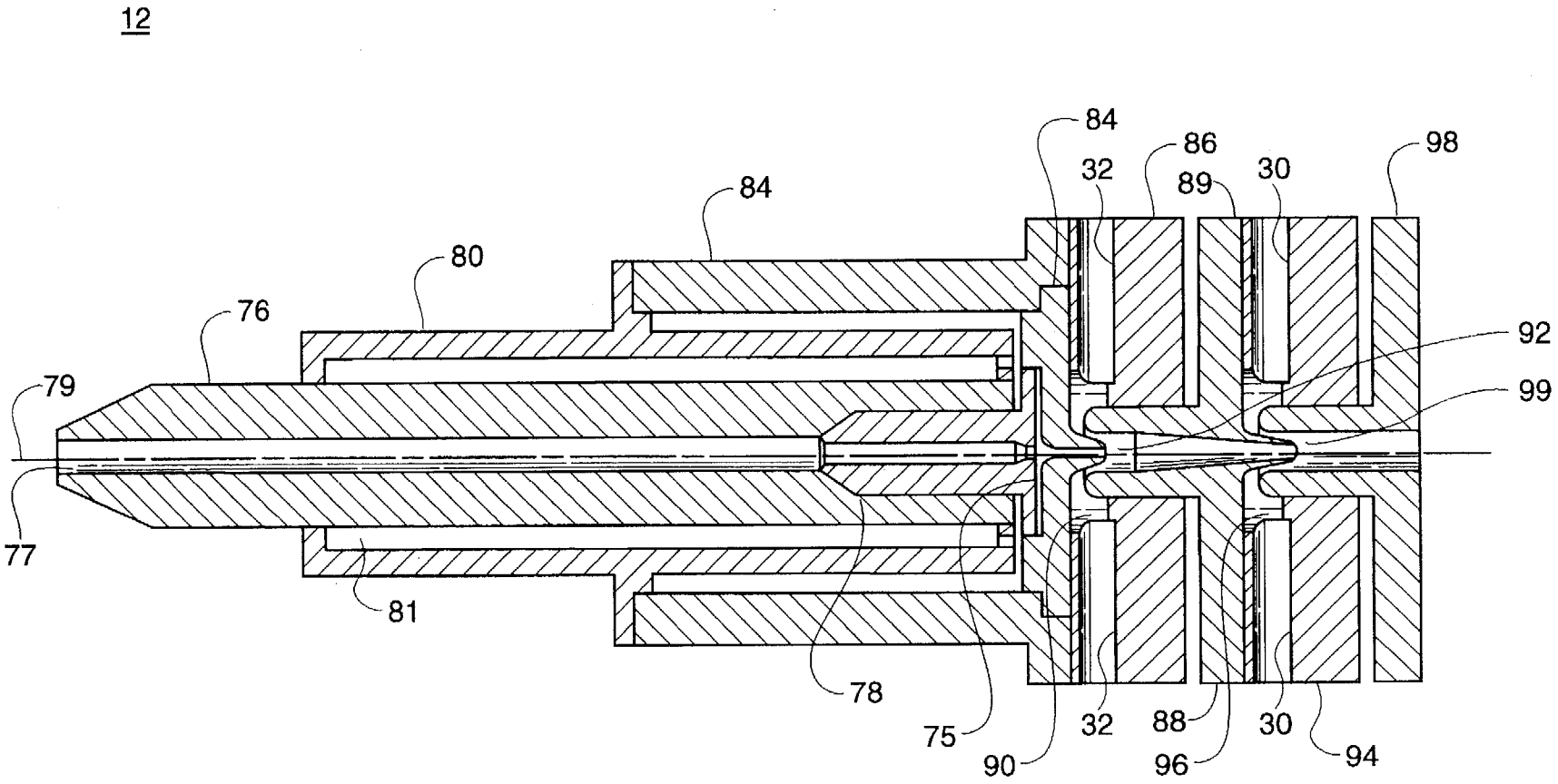
FIG. 4 is a cross section view of the continuous flow nozzle assembly shown in FIG. 3 taken along the plane 4—4.

A continuous flow nozzle assembly 12 is shown in FIGS. 3 and 4 and comprises an elongated liquid nitrogen barrel 76 having a flow restricting orifice plug 78 (FIG. 4) at one end. An insulating housing 80 surrounds barrel 76 and defines an annular insulation space 81 between barrel 76 and housing 80 to prevent the liquid nitrogen flowing through passage 77 from absorbing excess heat from the nozzle assembly 12 and possibly boiling. A first nozzle 82 mounted to main support housing 84 is positioned adjacent orifice plug 78 and aligned with flow axis 79 so that a small gap 75 is created therebetween. A first base plate 86 mounted to main support housing 84 by a pair of clamp assemblies 83 (FIG. 3) defines, in combination with first nozzle 82, a first chamber 90 that is fluidically connected to an opposed pair of carbon dioxide inlets 32. A second nozzle 88 is mounted to the first base plate 86, so that it is also aligned with flow axis 79. The second nozzle 88 is positioned a spaced distance from the first nozzle 82, so that a small annular gap 92 exists between the nozzles 82 and 88.

A second base plate 94 is mounted to a flange 89, which is part of the second nozzle 88, by a pair of clamp assemblies 91, as shown in FIG. 3. The second base plate 94, together with second nozzle 88, defines a second chamber 96 that is fluidically connected to the nitrogen inlet 30. Actually, the nozzle assembly 12 shown in FIGS. 3 and 4 includes opposed pairs of both the carbon dioxide inlets 32 and the nitrogen inlets 30, as opposed to the respective single inlets 32 and 30 shown in FIG. 1. While either configuration will work, using a pair of opposed inlets has the advantage of providing increased flow rates with reduced frictional losses. Finally, a third nozzle 98, aligned with flow axis 79, is mounted to the second base plate 94 and is positioned a spaced distance from the second nozzle 88, so that a small annular gap 99 is defined between the second nozzle 88 and the third nozzle 98.

During operation, the ultra high pressure liquid nitrogen from pump 64 flows through passage 77 and into the flow restricting orifice plug 78. A fine stream of liquid nitrogen leaves orifice plug 78 at a high velocity and enters the first nozzle 82. As the high velocity liquid nitrogen jet enters the first nozzle 82 it drags along with it air molecules within gap 75, thus evacuating gap 75 to provide additional thermal insulation between the nozzle assembly 12 and the liquid nitrogen within barrel 76. After passing through the first nozzle 82, the liquid nitrogen jet then enters the second nozzle 88. A positive pressure differential between the carbon dioxide gas which enters the first chamber 90 and the interior of nozzle 88 forces the carbon dioxide gas within chamber 90 into the nozzle 88 through the small annular gap 92. Upon contact with the liquid nitrogen stream, the gaseous carbon dioxide solidifies and forms the dry ice particle sheath 24 that surrounds the high velocity liquid nitrogen jet 22 (FIG. 1). Similarly, high pressure nitrogen gas which enters the second chamber 96 passes through the annular gap 99 between the second and third nozzles 88, 98 and forms the high velocity outer jacket 26 (FIG. 1). As described above, the high velocity gaseous nitrogen outer jacket 26 prevents feathering of the stream 20 and helps to maintain the integrity of the liquid nitrogen jet 22 and particle sheath 24.

With a liquid nitrogen pressure of about 60,000 psig, a gaseous nitrogen pressure of about 6,000 psig, and a carbon dioxide pressure in the range of about 20 psig to 800 psig, the nozzle assembly 12 shown in FIGS. 3 and 4 will produce a stream 20 having a velocity in excess of 3,000 feet per second, with the speeds of the liquid nitrogen jet 22, dry ice particle sheath 24, and gaseous nitrogen outer jacket 26 all being substantially equal.

While the nozzle assembly 12 shown in FIGS. 3 and 4 produces a continuous stream 20, and is, therefore, suitable for many uses, there may be certain circumstances where it is desirable to produce a pulsed stream, i.e., a stream wherein the flow of the carbon dioxide particle sheath 24 and outer jacket 26 can be selectively enabled and disabled (i.e., pulsed). A nozzle assembly for producing such a pulsed stream is shown in FIG. 5.

Figure 5:
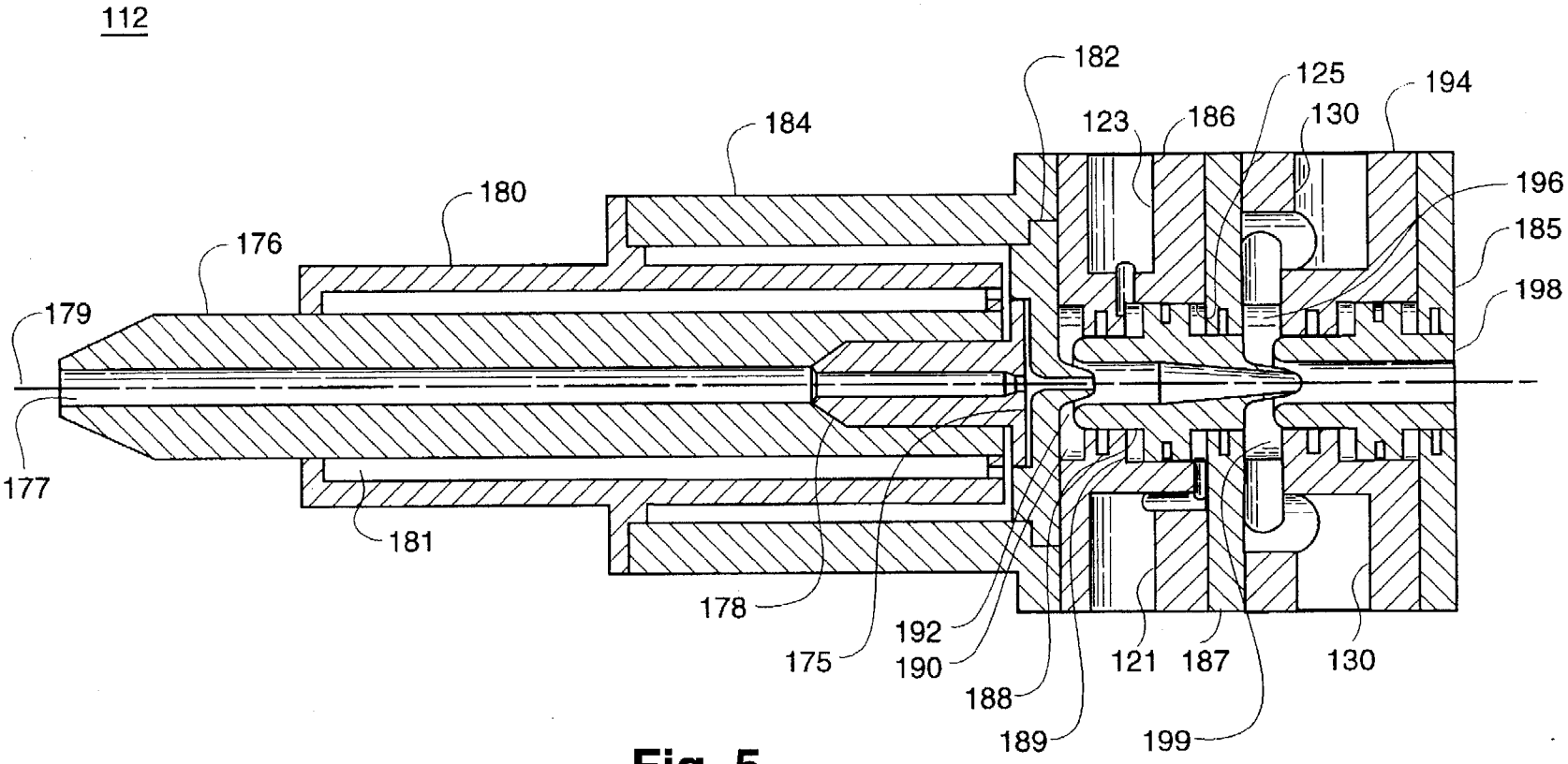
FIG. 5 is a cross section view of another embodiment of the tri-state nozzle assembly according to the present invention for producing a pulsed flow.

The pulsating nozzle assembly 112 of FIG. 5 is similar in many respects to the continuous flow nozzle assembly 12 shown in FIGS. 3 and 4, except that the second and third nozzles 188 and 198 are slidably mounted within the nozzle assembly 112, so that the respective annular gaps 192 and 199 for admitting carbon dioxide gas and nitrogen gas can be selectively opened and closed. Consequently, the second embodiment 112 allows the amount of dry ice in the particle sheath as well as the amount of nitrogen gas within the outer jacket 26 to be controlled.

Essentially, the pulsating nozzle assembly 112 shown in FIG. 5 comprises an elongated liquid nitrogen barrel 176 surrounded by an insulating housing 180 and a main support housing 184. As was the case for the first embodiment 12, the second nozzle embodiment 112 includes an annular insulating space 181 between the barrel 176 and the insulating housing 180. Also, the liquid nitrogen barrel 176 includes at one end a flow restricting orifice plug 178. A first nozzle 182 aligned with flow axis 179 is positioned in spaced apart relation to the flow restricting orifice plug 178, so that a small vacuum space 175 is created therebetween. A second nozzle 188 is slidably mounted within cylinder 125 (best seen in FIG. 6) of first base plate 186, so that it is free to slide back and forth in a direction parallel to the flow axis 179. A second base plate 194 supports a third nozzle 198 and is separated from the first base plate 186 by a spacer plate 187. The third nozzle 198 is also slidably mounted within second base plate 194 so that it is free to slide along back and forth in a direction parallel to the flow axis 179. An end cap 185 axially retains the third nozzle 198 in position as shown.

Figure 6:
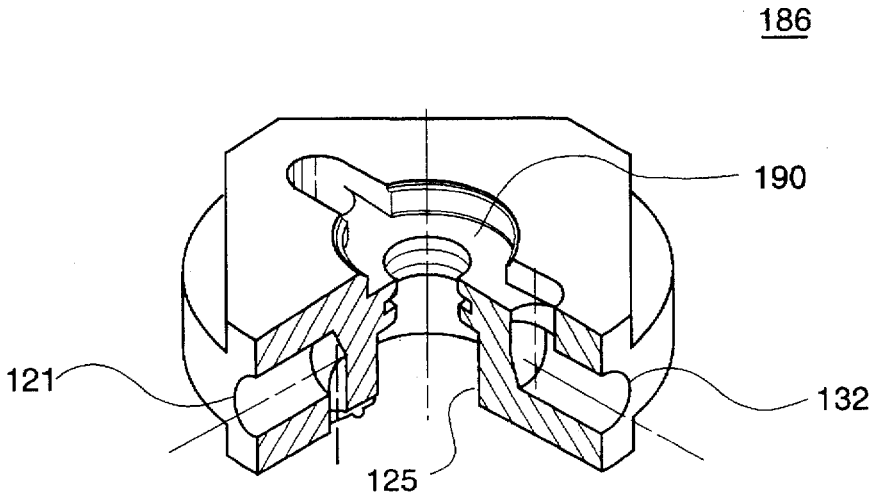
FIG. 6 is a perspective view of the first base plate of the pulsed flow nozzle assembly shown in FIG. 5, but with a portion broken away to more clearly show the structure and arrangement of the hydraulic passages and carbon dioxide inlets.

The first and second base plates 186 and 194 are identical and are best described by simultaneous reference to FIGS. 5 and 6. As was the case for the first base plate 86 in the first nozzle assembly embodiment 12, the first base plate 186 in the second nozzle assembly embodiment 112 includes a first chamber 190 that is fluidically connected to the pair of carbon dioxide inlet passages 132 (only one inlet passage 132 can be seen in FIG. 6). However, base plate 186 also includes a pair of hydraulic ports 121 (FIG. 6) and 123 (FIG. 5) that communicate with opposite sides of the nozzle cylinder 125, as best seen in FIG. 5. Hydraulic pressure can then be selectively applied to opposite sides of the flange 189 on the second nozzle 188, thus forcing the nozzle 188 to oscillate back and forth within nozzle cylinder 125. The second nozzle 188 is designed to close the gap 192 when it is moved all the way to the left. Conversely, when the nozzle 188 is moved all the way to the right, the gap 192 is the largest. Therefore, a suitable hydraulic control device (not shown) can be used to provide alternating hydraulic pressure to opposite sides of the flange 189, thus move the nozzle 188 back and forth to control the amount of carbon dioxide particles in the stream. If the second nozzle 188 is oscillated back and forth, a pulsed particle flow can be achieved. The third nozzle 198 is identically mounted within second base plate 194, and can be similarly oscillated to produce a pulsating gaseous nitrogen outer jacket 26.

Finally, while the respective first and second base plates 186 and 194 are identical, they are shown in FIG. 5 mounted at a 90° offset so that the details of the respective hydraulic ports 121 and 123 and the nitrogen inlets 130 can be seen more easily.

Figure 7:
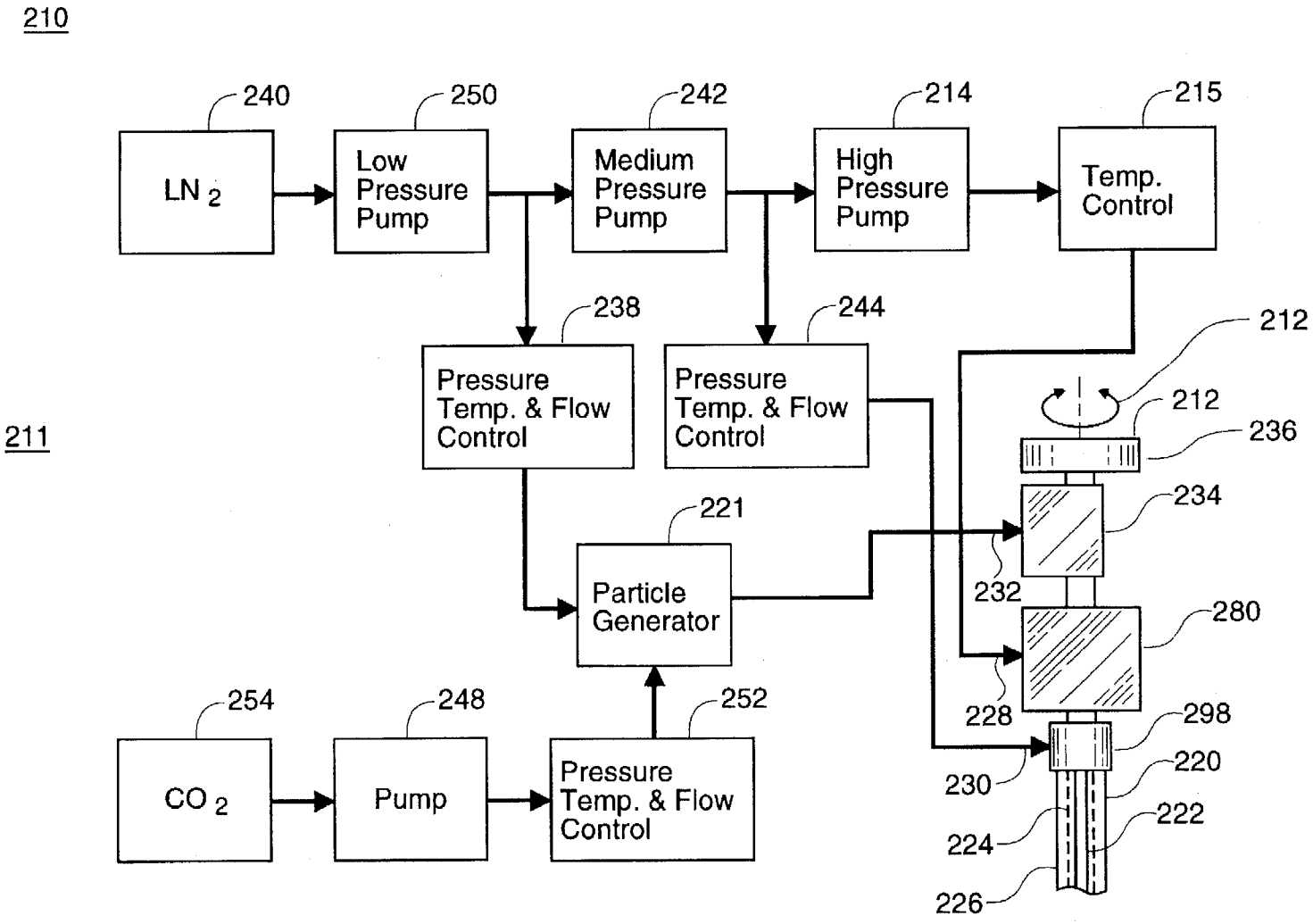
FIG. 7 is a block schematic diagram of the system for cutting and abrading with sublimable particles according to another embodiment of the present invention.

Another embodiment 210 of the cutting and abrading system according to the present invention is shown in FIG. 7 as it could be used with a special core injection nozzle assembly 212 to produce a high velocity tri-state particle stream 220 having a central core 222 that is made up of a slurry, i.e., a mixture of solid particles and a liquefied gas. The central core or slurry 222 is surrounded by a sheath 224 of liquefied gas, and the liquid sheath 224 is itself surrounded by a gaseous outer jacket 226. Thus, the tri-state particle stream 220 produced by the core injection nozzle assembly 212 shown in FIG. 7 differs from the tri-state particle sheath of the earlier embodiments and shown in FIG. 1 in that the central core 222 of particle stream 220 comprises a slurry, not a liquefied gas, as was the case for the earlier embodiments. The main advantage of the tri-state particle stream 220 is that the slurry comprising central core 222 may comprise larger solid particles than the particles in particle sheath 24 of the earlier embodiments. The larger particles result in increased abrasive and/or cutting action of the particle stream 220.

It should be noted, however, that the precise character of the tri-state particle stream 220 may vary depending on the particular pressure and temperature of the various compositions within the stream 220. For example, the sheath 224 may comprise a liquefied gas, a mixture of a liquefied gas and a cryogenic gas, or purely a cryogenic gas; the term "cryogenic" as used herein designating a composition having a temperature below about −100° F. Similarly, the slurry comprising the central core 222 may comprise a greater or lesser percentage (on a weight basis) of solid particles, again depending on the particular pressure and temperature of the compositions contained within the central core 222. Consequently, the precise character of the tri-state particle stream 220 should not be regarded as limited to combinations of compositions that are in purely a solid, liquid, or gaseous state.

The second embodiment 210 of the cutting and abrading system according to the present invention also utilizes a slightly different cryogenic system 211 than the cryogenic system 11 used in the first embodiment 10. Perhaps the most significant difference is that the cryogenic system 211 utilizes a particle generator 221 to generate the slurry that contains the larger frozen $CO_2$ particles. Another difference is that the high pressure pump system 214 used to deliver ultra-high pressure liquid nitrogen to the nozzle 212 incorporates phased multiple hydraulic pumps 223,225 (FIG. 8) which allow the liquid nitrogen to be delivered at extreme pressures without the pressure fluctuations typically associated with other types of ultra high pressure cryogenic pumps. The cryogenic system 211 also utilizes a special temperature control system 215 which includes a high pressure heat exchanger 260 (FIG. 10) for accurately controlling the temperature of the high pressure liquid nitrogen.

The core injection nozzle assembly 212 also differs significantly from the nozzles 12 and 112 described above. One significant difference, of course, is that the core injection nozzle assembly 212 produces a tri-state particle stream 220 wherein the abrasive $CO_2$ particles are contained within the central core 222 as a slurry, as opposed to being in a particle sheath 24 surrounding a liquid central core 22, as was the case for the particle stream 20 produced by the nozzles 12 and 112. See FIG. 1. Control of the relative thickness of the liquid sheath 224 is also accomplished somewhat differently in the nozzle 212. More specifically, nozzle 212 incorporates a moveable primary nozzle 282 (FIG. 17) that can be moved toward and away from the tapered inlet 287 of a secondary nozzle 288 to decrease and increase the thickness of the liquid sheath 224.

Another significant difference associated with the core injection nozzle assembly 212 is that it includes a high pressure rotating coupling 234 that allows the control handle 236 to be rotated in the direction indicated by arrows 237 to move the primary nozzle 282 toward and away from the tapered inlet 287 of the secondary nozzle 288, thus change the thickness of the liquid sheath 224 of the tri-state particle stream 220. As was the case for the first two nozzle embodiments 12 and 112, however, the core injection nozzle assembly 212 may be provided with a third or tertiary nozzle assembly 298 to allow for the injection of gaseous nitrogen to form the gaseous outer sheath 226.

Having briefly described the embodiment 210 of the cutting and abrading system according to the present invention, as well as some of its more significant differences and advantages, the cutting and abrading system 210 will now be described in detail. Referring now to FIG. 7, the cryogenic system 211 is used to supply liquid nitrogen under extreme pressure and gaseous nitrogen under moderate pressure to the core injection nozzle assembly 212. Cryogenic system 211 is also used to provide to the nozzle assembly 212 a slurry 216 (FIG. 11) comprising frozen $CO_2$ particles and liquid nitrogen. However, before proceeding with a detailed description of the cryogenic system 211, it should be noted that the following description is only directed to those devices unique to this invention or that are required to provide an enabling disclosure. FIG. 7, therefore, does not show, nor does the following description describe, other components, such as pressure regulators, check valves, filters, or compressor cooling systems that would be generic to such a cryogenic system 211 or that may be required for certain installations or applications. Put in other words, since systems for delivering pressurized gases and cryogenic liquids have existed for decades and are well-known, it would be obvious to persons having ordinary skill in the art to add to the cryogenic system shown and described herein those additional components that may be necessary or desirable for a specific installation or application.

Cryogenic system 211 comprises a liquid nitrogen tank 240 that contains a supply of liquid nitrogen (not shown) that may be maintained at pressures ranging from less than 2 psig to 20 psig. A low pressure pump system 250 draws liquid nitrogen from the tank 240 and increases its pressure to a pressure in the range of about 20 to 120 psig. A portion of the low pressure liquid nitrogen from the low pressure pump system 250 flows through an appropriate pressure, temperature, and flow control system 238 and into the particle generator 231, as will be described in greater detail below. The remaining liquid nitrogen from the low pressure pump system 250 is drawn into the medium pressure pump system 242, which increases the pressure of the liquid nitrogen to about 3,000 to 15,000 psig. Optionally, a portion of the liquid nitrogen from the medium pressure pump system 242 may be diverted through another pressure, temperature, and flow control system 244 and injected as a gas into the optional third or tertiary nozzle assembly 298. The remaining liquid nitrogen from the medium pressure pump system 242 is drawn into the high pressure pump system 214, which increases the pressure of the liquid nitrogen to extreme pressures in the range of about 4,000 to 75,000 psig depending on the desired application. Generally speaking, liquid nitrogen under such high pressures changes state into a gas, thus making it necessary to cool the ultra high pressure nitrogen to return it to a liquid or a supercritical liquid state. The temperature control system 215 provides the cooling necessary to change the state of the ultra high pressure nitrogen.

The frozen carbon dioxide ($CO_2$) particles (not shown) that form the abrasive particles contained within slurry 216 (FIG. 11) are produced by the particle generator system 221. Gaseous carbon dioxide is drawn from the carbon dioxide tank 254 by a pump system 248 which increases the pressure of the $CO_2$ to a pressure in the range of about 1,000 to 2,000 psig. Alternatively, much higher pressures, such as pressures as high as about 15,000 psig, could also be used if very high stream velocities are desired. However, such high $CO_2$ pressures tend to increase nozzle wear. A pressure, temperature, and flow control system 252 regulates the pressure, temperature, and flow of the carbon dioxide that flows into the particle generator 221.

Figure 8:
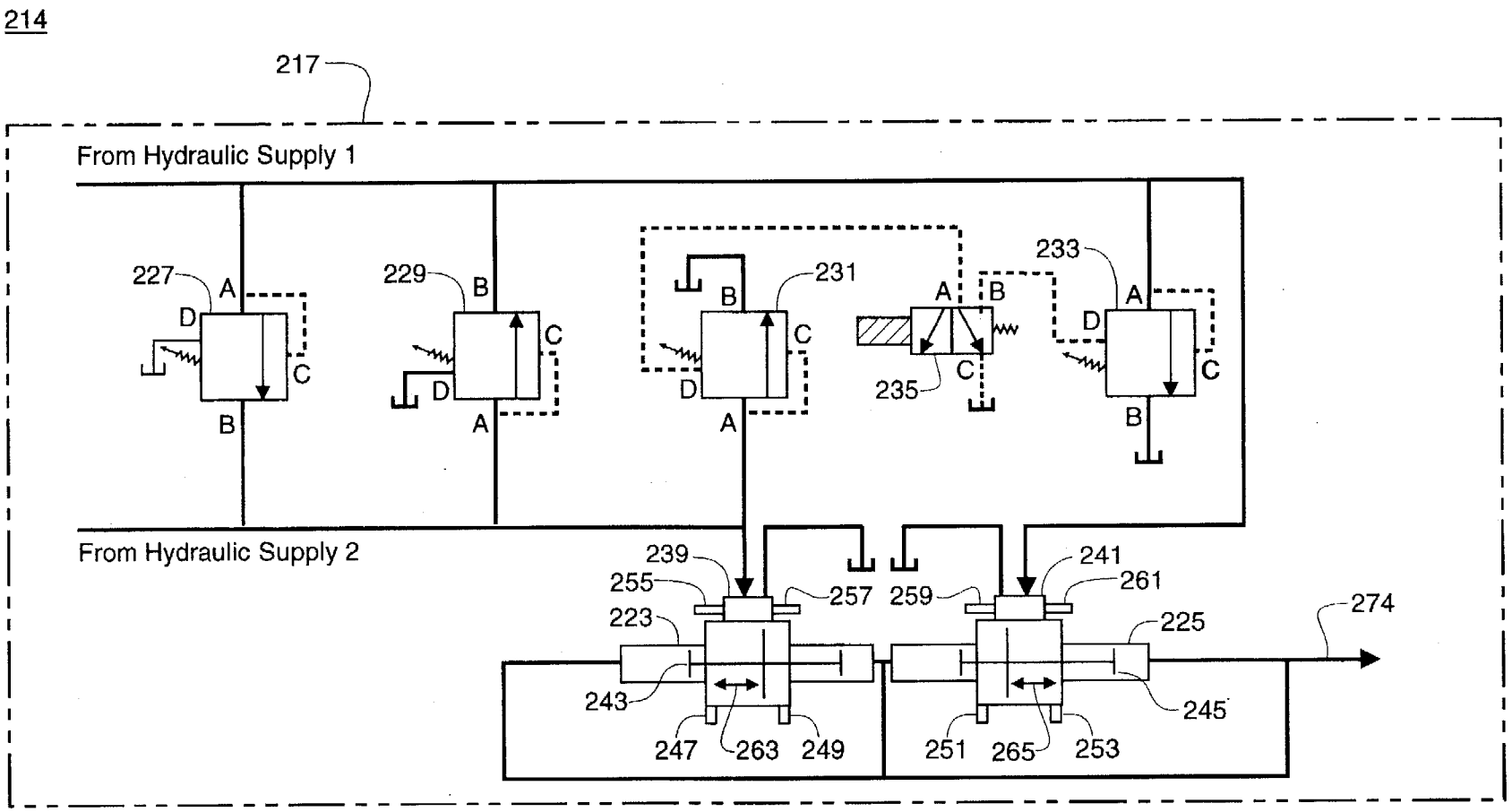
FIG. 8 is a schematic diagram of the hydraulic control system portion of the high pressure pump system shown in FIG. 7.
Figure 9:
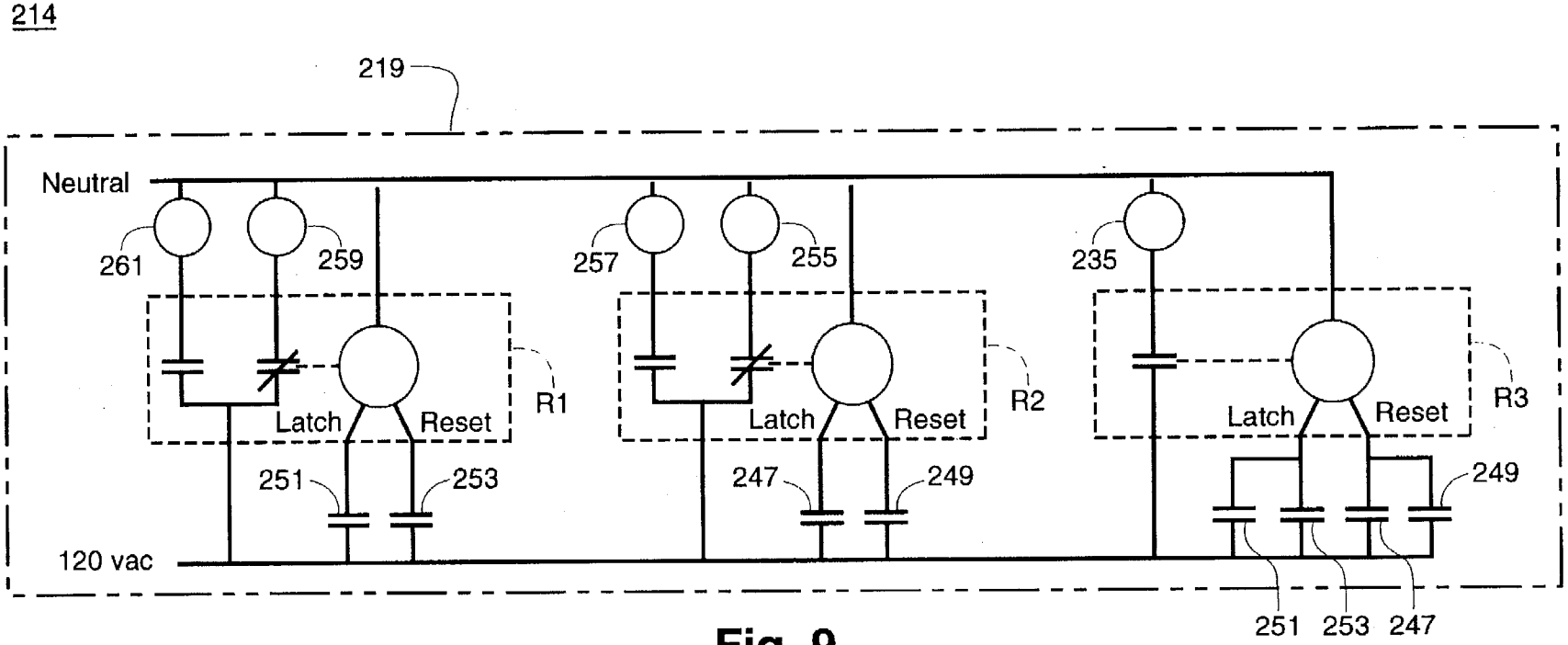
FIG. 9 is a schematic diagram of the electrical control system portion of the high pressure pump system shown in FIG. 7.

Referring now to FIGS. 8 and 9, the high pressure pump system 214 comprises a hydraulic control system portion 217 (FIG. 8) and an electrical control system portion 219 (FIG. 9). As was mentioned above, the high pressure pump system 214 is phased so that the two hydraulically actuated ultra high pressure pumps 223, 225 deliver the ultra high pressure nitrogen to the nozzle assembly 212 at a substantially constant pressure with very little pressure fluctuation. The phased high pressure pump system 215 accommodates to a greater extent the compressibility of gases than other types of commonly used high pressure pumping systems.

The hydraulic control system portion 217 of high pressure pump system 214 is best understood by referring to FIG. 8 and comprises a pair of sequencing valves 227, 229 connected between two separate pressure compensated hydraulic supplies (not shown) but designated in FIG. 8 as "Hydraulic Supply 1" and "Hydraulic Supply 2." Alternatively, constant displacement hydraulic supplies could also be used. Sequencing valve 227 is connected to the hydraulic supplies such that port "A" is connected to "Hydraulic Supply 1" and port "B" is connected to "Hydraulic Supply 2." Port "C" of valve 227 is connected to port "A" to provide a pressure sensing function, and port "D" of valve 227 is connected to a reservoir of hydraulic fluid (shown in schematic in FIG. 8). Thus, valve 227 maintains a constant relief pressure with varying back pressure, i.e., sequencing valve 227 allows hydraulic fluid to flow from port "A" to port "B" to help to equalize the pressure of "Hydraulic Supply 1" and "Hydraulic Supply 2." Sequencing valve 229 is similarly connected so that port "A" is connected to "Hydraulic Supply 2" and so that port "B" is connected to "Hydraulic Supply 1." As was the case for sequencing valve 227, hydraulic fluid is allowed to flow from port "A" to port "B" of valve 229 to help to equalize the pressure of "Hydraulic Supply 1" and "Hydraulic Supply 2." In one preferred embodiment, sequencing valves 227 and 229 open at a pressure of about 2900 psig, i.e., the valves "open" to connect port "A" to port "B" when the pressure at port "A" of each valve reaches 2900 psig.

Another pair of sequencing valves 231 and 233 are connected so that they drain through a three-way valve 235 such that only one sequencing valve 231, 233 drains at a time to the reservoir (shown in schematic) of hydraulic fluid. Port "A" of valve 231 is connected to "Hydraulic Supply 2" and the drain or port "D" is connected to three-way valve 235. Similarly, port "A" of valve 233 is connected to "Hydraulic Supply 1" and the drain or port "D" of valve 233 is connected to three-way valve 235. Port "B" of each valve 231, 233 relieves to the hydraulic reservoir (not shown). Ports "A" of valves 231 and 233 are connected to respective solenoid activated four-way valves 239, 241 mounted to high pressure pumps 223 and 225, respectively. In one preferred embodiment, valves 231 and 233 are set to open at a pressure of about 2800 psig, i.e., port "A" is connected to port "B" when the hydraulic pressure at port "A" of each valve reaches 2800 psig.

Each high pressure pump 223, 225 comprises a respective piston assembly 243, 245 that is activated by hydraulic fluid controlled by the respective four-way valve assemblies 239, 241. Each pump assembly 223 and 225 also includes a respective pair of limit switches 247, 249 and 251, 253 to sense when each respective piston assembly 243, 245 has moved to either extreme end of its travel. Each four-way valve 239 and 241 is activated by a respective pair of solenoids 255, 257 and 259, 261, which control the flow of hydraulic fluid to move the respective piston assemblies 243 and 245 back and forth within the pumps in the directions indicated by arrows 263 and 265 to accomplish pumping of the liquid nitrogen through high pressure nitrogen outlet line 274.

The electrical system portion 219 of high pressure pump system 214 is best seen in FIG. 9 and comprises three relays R1, R2, and R3 for controlling the operation of the various solenoids 235, 255, 257, 259, and 261 of the hydraulic control system portion 217 shown in FIG. 8 and described above. More specifically, relay R1 is connected to limit switches 251 and 253 and actuates solenoids 259 and 261. Relay R2 is connected to limit switches 247 and 249 and actuates solenoids 255 and 257. Thus, relays R1 and R2 control the operation of the four way valves 241 and 239, respectively. Relay R3 controls the operation of solenoid-activated three-way valve 235 and is connected to all four limit switches 247, 249, 251, and 253. When the relays R1, R2, and R3 are in the "reset" position, solenoids 261 and 257 are activated and solenoids 235, 255, and 259 are de-activated.

Referring now to FIGS. 8 and 9 simultaneously, hydraulic control system portion 217 and electrical control system portion 219 operate the compressors 223 and 225 in the following manner. As an initial starting point, assume compressor 225 is working or compressing nitrogen into the high pressure nitrogen line 274. Then, solenoid 261 on four-way valve 241 will be activated and the piston assembly 245 will be approaching limit sensor 251 (i.e., piston assembly 245 is moving to the left), and the three-way valve 235 is in its de-activated state, as shown in FIG. 8. That is, hydraulic fluid vented from port "of sequencing valve 231 will flow to the hydraulic reservoir by way of ports "A" and "C" of three-way valve 235. When the hydraulic pressure to compressor 225 reaches 2900 psig, excess hydraulic fluid from "Hydraulic Supply 1" is diverted from compressor 225 through ports "A" and "B" of sequencing valve 227 to "Hydraulic Supply 2," thus to compressor 223. The added flow to "Hydraulic Supply 2" increases the speed of compressor 223, allowing it to "catch up" with compressor 225. That is, the outlet pressure of compressor 223 approaches the outlet pressure of compressor 225. This condition continues until the hydraulic pressure in "Hydraulic Supply 2" reaches 2800 psig, as sensed at port "C" of sequencing valve 231. The pressure of 2800 psig is sufficient to activate sequencing valve 231, which connects ports "A" and "B" and vents hydraulic fluid from "Hydraulic Supply 2" back to the reservoir. Thus, the activation of sequencing valve 231 has the effect of stalling or holding compressor 223 while compressor 225 continues to move the nitrogen in high pressure nitrogen line 274.

When the piston assembly 245 of compressor 225 reaches the end of its stroke, limit switch 251 closes, which latches relay R3 and activates three-way valve 235. So activated, three-way valve 235 prevents the venting of hydraulic fluid from port "D" of sequencing valve 231, thus disabling sequencing valve 231. At the same time, sequencing valve 233 is enabled. That is, hydraulic fluid is allowed to flow from port "D" of valve 233 to the reservoir through ports "B" and "C" of three-way valve 235. Compressor 223 is now the working compressor and is no longer in a stalled or hold mode and begins to compress nitrogen in high pressure nitrogen line 274. As the nitrogen is compressed, the hydraulic pressure actuating compressor 223 starts to increase. Once the hydraulic pressure reaches 2900 psig, as sensed through port "C" of sequencing valve 229, excess hydraulic fluid from "Hydraulic Supply 2" will flow into "Hydraulic Supply 1," thus compressor 225, via ports "A" and "B" of sequencing valve 229. Compressor 225 can now "catch up" with compressor 223. That is, the outlet pressure from compressor 225 begins to increase. When the hydraulic pressure in "Hydraulic Supply 1" feeding compressor 225 increases to 2800 psig, as sensed through port "C" of sequencing valve 233, sequencing valve 223 will open, and hydraulic fluid from "Hydraulic Supply 1" will flow into the reservoir via ports "A" and "B" of valve 233. Compressor 225 will now stall or hold while compressor 223 continues to move the nitrogen into high pressure nitrogen line 274. The foregoing process continues to repeat as described above.

As the piston assemblies 243 and 245 of respective compressors 223 and 225 move back and forth, they open and close the limit switches 247, 249, 251 and 251, which activate the various relays R1, R2, and R3, which in turn activate the four way valves 239 and 241 to operate compressors 223 and 225 and activate the three-way valve 235. The operation of the electrical control system portion is best understood by considering the following example.

Assume that the high pressure pump system 214 is initially operating such that the relays R1, R2, and R3 are all in the "reset" position (i.e., solenoids 257 and 261 are activated and solenoids 255, 259, and 235 are de-activated) and assume that compressor 225 is leading compressor 223, with the respective piston assemblies 245 and 243 moving in the same direction so that they will activate or close limit switches 251 and 247, respectively. When the piston assembly 245 of compressor 225 reaches the end of its travel and actuates limit sensor 251, relays R1 and R3 are activated. Activation of relay R1 "latches" the R1 contacts in an opposite state, thus de-energizing solenoid 261 and energizing solenoid 259 and reversing the direction of travel of piston assembly 245. Activation of relay R3 "latches" the R3 contacts in an opposite state, thus energizing solenoid actuated sequencing valve 235. Similarly, when the piston assembly 243 of compressor 223 reaches the end of its travel and actuates limit sensor 247, relays R2 and R3 are activated. Activation of relay R2 "latches" the R2 contacts in the opposite state, thus de-energizing solenoid 257 and energizing solenoid 255 and reversing the direction of travel of piston assembly 243. Activation of relay R3 "resets" the R3 contacts, thus de-energizing sequencing valve 235.

Next, the piston assembly 245 of compressor 225 reaches the end of its travel in the opposite direction and actuates limit sensor 253. Limit sensor 253 in turn activates relays R1 and R3. Activation of relay R1 "resets" the R1 contacts, which energizes solenoid 261 and de-energizes solenoid 259, thus reversing the direction of travel of the piston assembly 245. Activation of relay R3 "latches" the R3 contacts in the opposite state which energizes the sequencing valve 235. Similarly, when the piston assembly 243 of compressor 223 reaches the end of its opposite direction travel and actuates limit sensor 249, relays R2 and R3 are activated. Activation of relay R2 "resets" the R2 contacts, thus de-energizing solenoid 255 and energizing solenoid 257 and reversing the direction of travel of piston assembly 243. Activation of relay R3 "resets" the R3 contacts, thus de-energizing sequencing valve 235. Again, this process continues to repeat.

Figure 10:
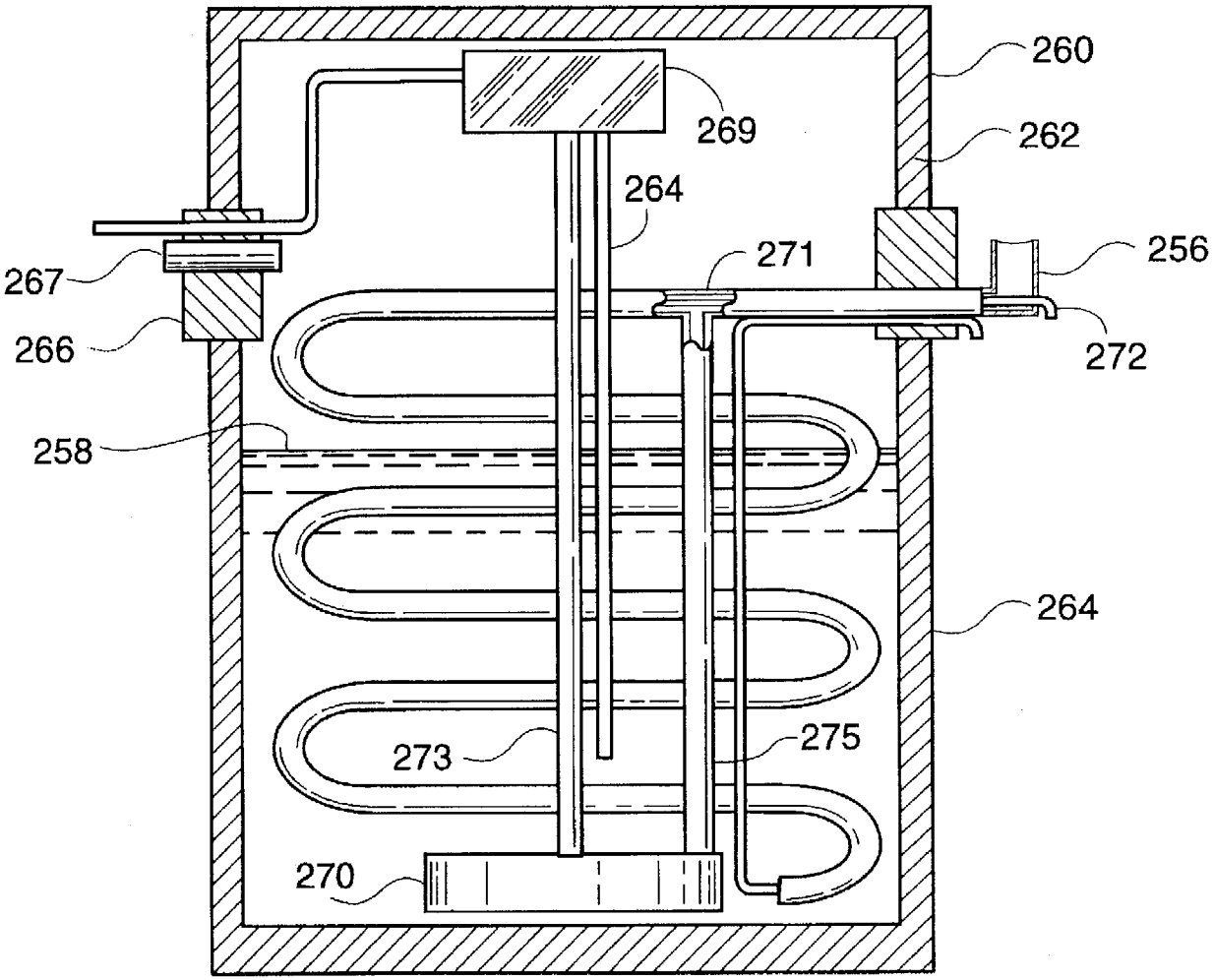
FIG. 10 is a sectional view in elevation of the temperature control system shown in FIG. 7.

After being compressed by the high pressure pump system 214, the nitrogen will be under extreme pressures up to about 75,000 psig. At this pressure, the nitrogen has returned to a gaseous state and must be cooled to change it back into a liquid. The required cooling is accomplished by the temperature control system 215 (FIG. 7), which essentially comprises a tube-in-tube-in shell high pressure heat exchanger 260 as best seen in FIG. 10. The shell of heat exchanger 260 comprises an upper shell portion 262 and a lower shell portion 264 that are connected together by a ring member 266, which also provides an interface through which access to the interior of the shell of heat exchanger 260 is established. In one preferred embodiment, upper and lower shell portions 262 and 264 comprise inside and outside metal skins separated by a vacuum core to provide the required degree of thermal insulation, although other materials could also be used.

Heat exchanger 260 includes a high pressure nitrogen line 271 surrounded by a low pressure liquid nitrogen tube 256. The heat exchanger 260 also includes a vent line 267, a level sensor 268 for sensing the amount of liquid nitrogen 258 within the lower shell portion 264, and a motor 269 for driving a liquid nitrogen pump 270. High pressure nitrogen from the high pressure pump system 214 enters the inlet 272 of high pressure line 271 and is cooled and re-liquefied by the low pressure liquid nitrogen flowing through tube 256. Excess liquid nitrogen from tube 256 is collected by the lower shell portion 264 and forms a liquid nitrogen bath 258, the level of which is sensed by level sensor 264. A nitrogen flow control system (not shown) connected to the level sensor 264 increases and decreases the flow in low pressure tube 256 as required to maintain the level of the liquid nitrogen bath 258 between a predetermined upper and lower limit. The temperature of the high pressure liquid nitrogen leaving the heat exchanger 260 is controlled by varying the flow rate of low pressure liquid nitrogen flowing in the annulus between low pressure tube 256 and high pressure tube 271. The flow rate of liquid nitrogen in the low pressure tube 256 may be varied as necessary by changing the rotational speed of motor 269 which is coupled to the liquid nitrogen pump 270 by shaft 273, which in turn draws more or less liquid nitrogen from bath 258 and pumps it through pump outlet tube 275 which is connected to tube 256 in the manner best seen in FIG. 10. If the temperature of the high pressure nitrogen is too high, then the flow rate of low pressure nitrogen in tube 256 is increased. Conversely, if the temperature of the high pressure nitrogen is too low, then the flow rate of liquid nitrogen in tube 256 is decreased. Thus, the presence of the liquid nitrogen bath 258 allows for the convenient control of the temperature of the high pressure liquid nitrogen in tube 271 regardless of the amount of low pressure liquid nitrogen entering tube 256 from the supply of liquid nitrogen 240 (FIG. 7). The cooled high pressure nitrogen leaving heat exchanger 260 may then be injected into the high pressure liquid nitrogen inlet 228 of nozzle 212, as best seen in FIG. 7.

Figure 11:
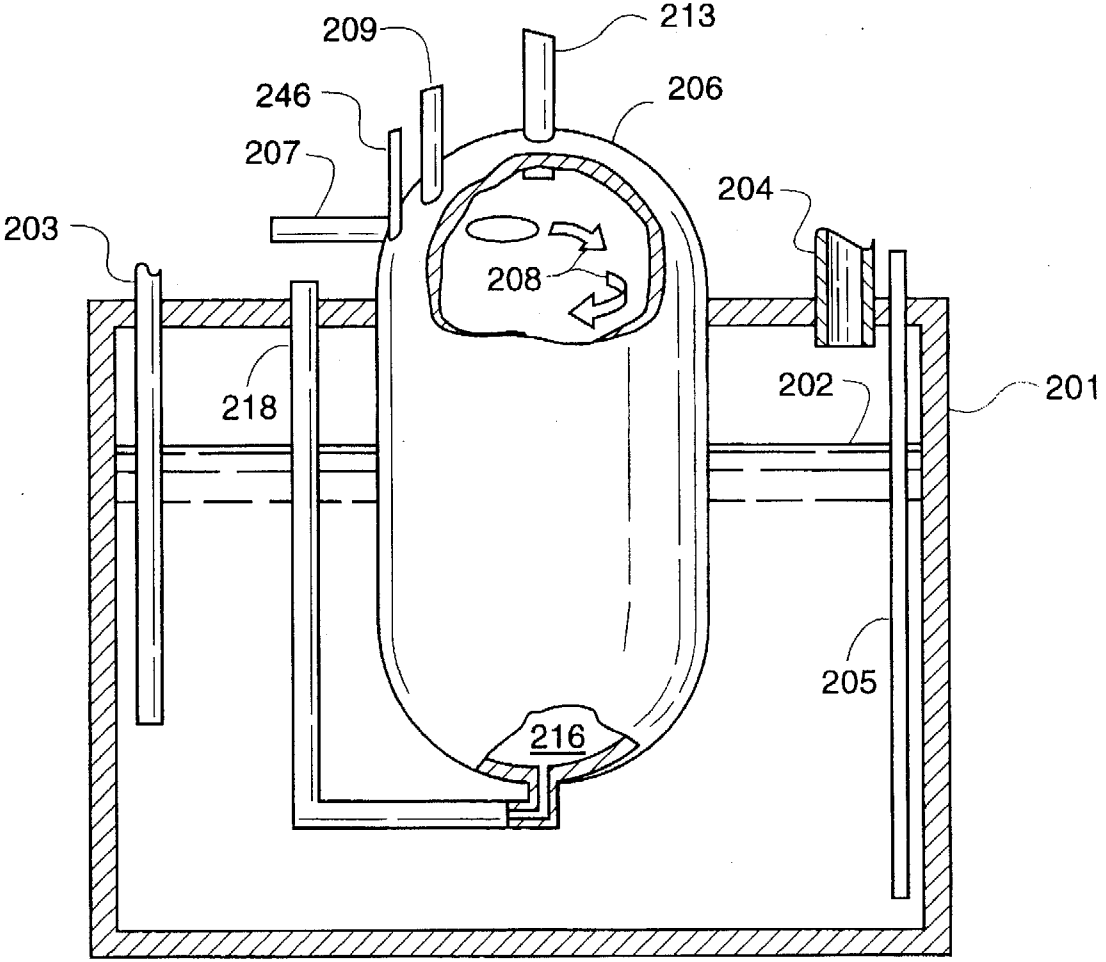
FIG. 11 is a sectional view in elevation of the particle generator system shown in FIG. 7.

The details of the particle generator 221 are best seen in FIG. 11. Essentially, particle generator 221 comprises a vacuum-insulated container 201 for holding a bath of liquid nitrogen 202. The liquid nitrogen for the bath 202 may be obtained from the liquid nitrogen tank 240 (FIG. 7) and enters the container 201 through an inlet 203. Gaseous nitrogen boiling off from bath 202 exits the container 201 through vent 204. The amount of liquid nitrogen in bath 202 is sensed by a level sensor 205 and may be controlled by a suitable control system (not shown) of the type well-known in the art. A pressure vessel 206 is partially submerged in the liquid nitrogen bath 202 and receives liquid/gaseous nitrogen from the pressure, temperature, and flow control system 238. The liquid/gaseous nitrogen is then injected into the pressure vessel 206 through inlet 207 which is oriented tangentially to the walls of the pressure vessel 206, so that the liquid/gaseous nitrogen forms a vortex or cyclone within the pressure vessel 206 as indicated by arrows 208. Gaseous nitrogen exits the pressure vessel through vent 209. Carbon dioxide from pressure, temperature and flow control system 252 enters the pressure vessel 206 through a droplet generating nozzle 213. The droplets (not shown) from nozzle 213 contact the liquid nitrogen swirling in the pressure vessel 206 solidify into small particles and, together with the liquid nitrogen, form a slurry 216 in pressure vessel 206. The slurry 216 exits the pressure vessel 206 through an outlet 218, whereupon it may be injected into the nozzle 212 via the slurry inlet 232 (FIG. 7). The amount of slurry 216 in pressure vessel 206 is sensed by a level sensor 246 and the slurry 216 may be maintained at a predetermined level by a suitable control system (not shown), for example, by varying the flow rate of liquid/gaseous nitrogen entering the pressure vessel 206.

Figure 12:
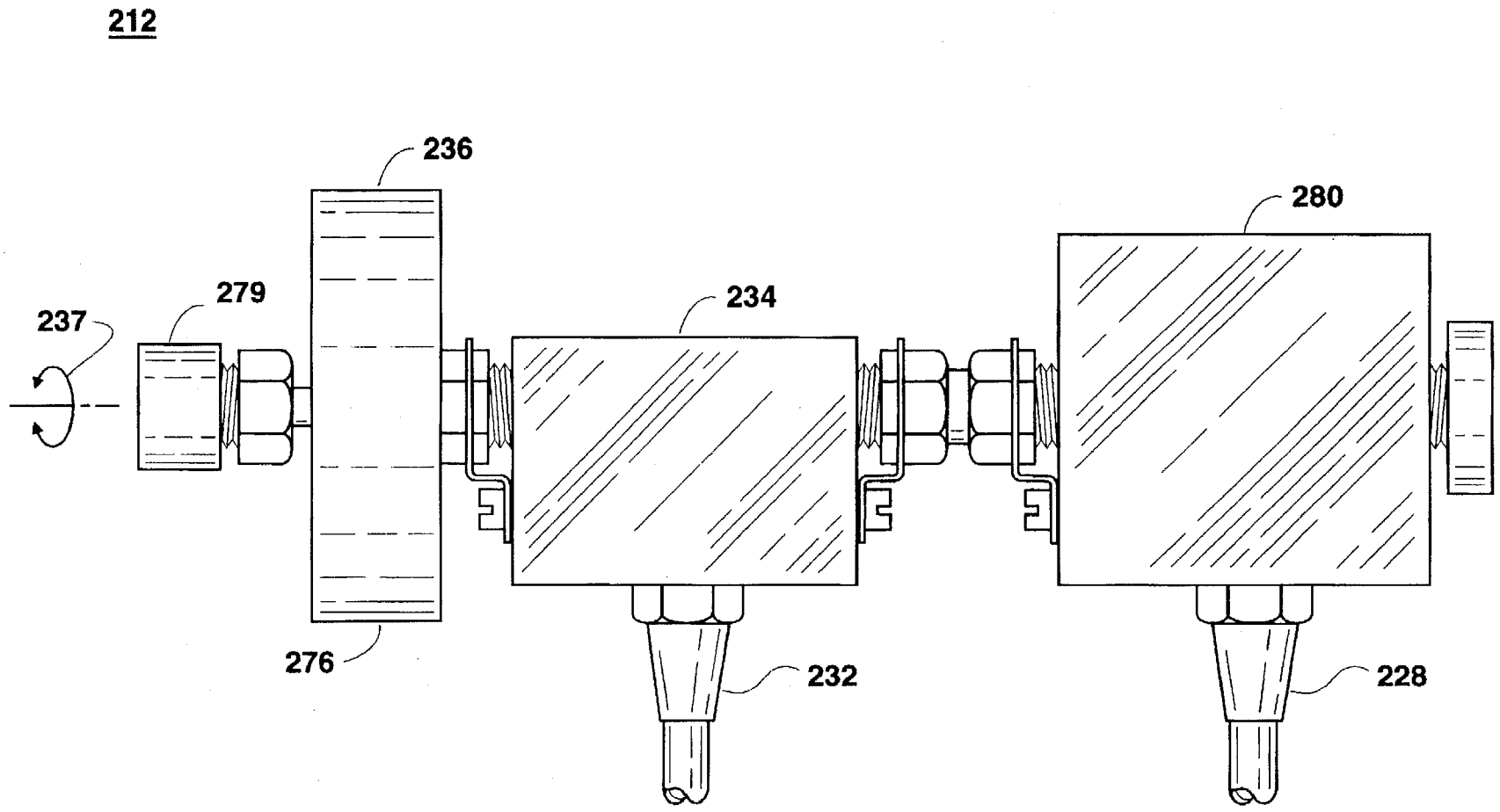
FIG. 12 is a side view in elevation of a nozzle having a high pressure rotating coupling.

The details of the core injection nozzle assembly 212 are best seen in FIGS. 12–17. Referring now to FIG. 12, core injection nozzle assembly 212 comprises a nozzle housing 280 to which are mounted the high pressure rotating coupling assembly 234 and a control handle assembly 236. As was briefly described above, the slurry 216 (FIG. 11) from the particle generator 221 enters the high pressure rotating coupling 234 via the slurry inlet fitting 232. The slurry 216 ultimately forms the central core 222 of tri-state particle stream 220, as best seen in FIG. 7. High pressure liquid nitrogen from the high pressure pump and temperature control systems 214, 215, respectively, enters the nozzle housing 280 via high pressure liquid nitrogen inlet 228 and ultimately forms the liquid sheath 224 of tri-state stream 220. Depending on the desired use, the nozzle assembly 212 may also include a third nozzle assembly 298 (not shown in FIG. 12, but shown in FIG. 7) for forming the gaseous outer sheath or jacket 226. The control assembly 236 of nozzle 212 is used to control the relative ratios of the slurry 216 comprising the central core 222 and the liquid nitrogen comprising the liquid sheath 224, thus changing the characteristics of the stream 220. As will be described in greater detail below, rotating the knob 276 of control assembly 236 in one direction (indicated by arrow 237 in FIG. 7) decreases the amount of high pressure liquid nitrogen in the stream 220, while rotating the knob 276 in the opposite direction increases the amount of high pressure liquid nitrogen in the stream 220.

Figure 13:
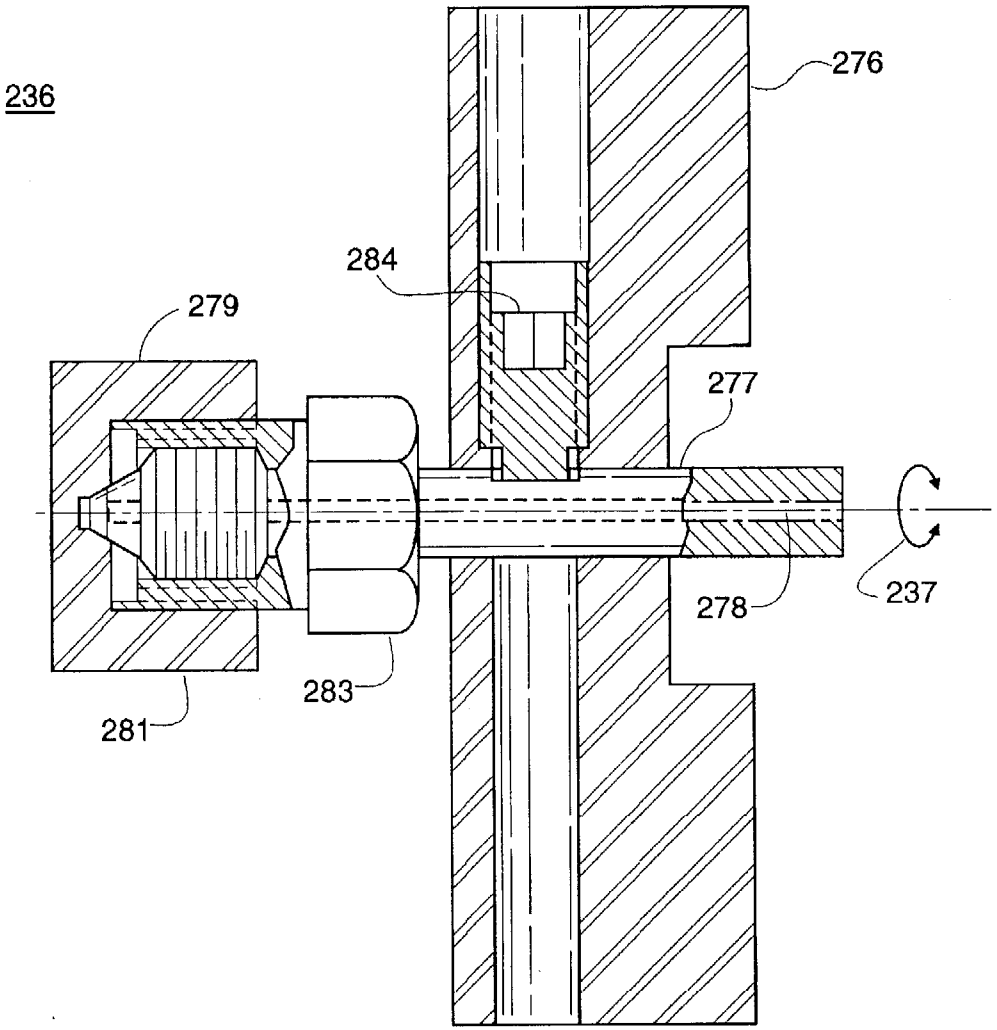
FIG. 13 is a sectional view in elevation of the control knob assembly of the nozzle shown in FIG. 12.

The details of the control assembly 236 are best seen in FIG. 13. The control knob 276 is attached to an elongate tube 277 that extends for nearly the entire length of the nozzle assembly 212 as will become apparent as this description progresses. The elongate tube 277 has a central bore 278 therethrough that extends through the entire tube 277. The bore 278 may be sealed off at one end of the elongate tube 277 by a suitable cap assembly 279 that includes an end cap 281 and a gland bolt 283. The control knob 276 may be attached to the elongate tube 277 by any convenient means, such as by a set screw 284, so that the elongate tube 277 can be rotated in the direction indicated by arrows 237.

Figure 14:
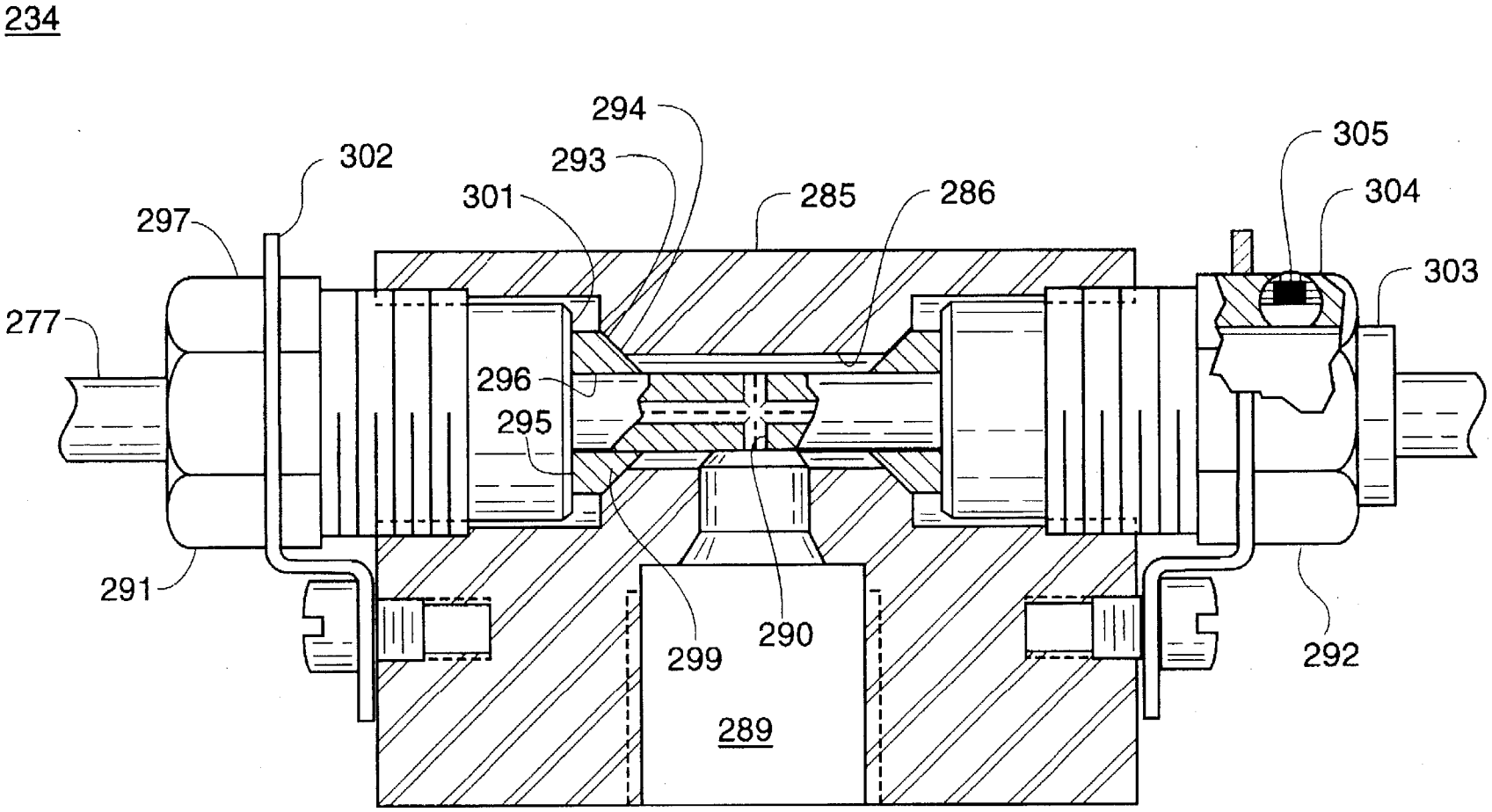
FIG. 14 is a sectional view in elevation of the high pressure rotating coupling shown in FIG. 12.

The high pressure rotating coupling 234 is best seen in FIG. 14 and comprises a main body 285 having a central bore 286 therethrough adapted to loosely receive the elongate tube 277 so that an annulus is created between the elongate tube 277 and the central bore 286. The main body 285 also includes a high pressure injection chamber 289 that is fluidically connected to the central bore 286. The high pressure injection chamber 289 is adapted to receive the high pressure slurry inlet fitting 232 (FIG. 12) and receives the high pressure slurry 216 from the particle generator 221 (FIG. 11). A transverse bore 290 in elongate tube 277 and in fluid communication with central bore 278 via the annulus between central bore 286 and elongate tube 277 allows slurry 216 (not shown in FIG. 14, but shown in FIG. 11) within the high pressure injection chamber 289 to flow into the central bore 278 of elongate tube 277. This slurry will ultimately become the central core 222 of stream 220, as best seen in FIG. 7.

The elongate tube 277 is allowed to rotate within the main body 285 to accomplish the function of varying the amount of high pressure liquid nitrogen that is allowed into the nozzle 212. The high pressure slurry contained within the injection chamber 289 and annulus created between the central bore 286 of main body 285 and the elongate tube 277 is prevented from leaking out of main body 285 by a pair of rotatable cone seal assemblies 291 and 292.

Cone seal assembly 291 comprises a cone member 293 having a conical end 294, a flat end 295, and a central bore 296 adapted to receive the elongate tube 277. A gland bolt 297 urges the cone member 293 toward a mating cone-shaped seat 299 in main body 285 to seal the elongate tube 277 within the body 285. A belleville washer 301 may be positioned between the gland bolt 297 and the flat end 295 of cone member 293 to keep help compensate for wear and to ensure better sealing performance. Finally, the gland bolt 297 may be prevented from loosening by any suitable means, such as a clip 302.

Rotating cone seal assembly 292 is essentially identical to the rotating cone seal assembly 291 and will, therefore, not be described in detail. However, rotating cone seal assembly 292 differs from seal assembly 291 in that cone seal assembly 292 is adapted to fixedly receive a tube or sleeve 303 surrounding tube 277. As will be described in greater detail below, sleeve 303 is fixedly mounted to the nozzle housing 280 and thus provides a means whereby the rotatable coupling 234 can be fixedly mounted to the nozzle housing 280. That is, sleeve 303 prevents the rotatable coupling 234 and nozzle housing 280 from rotating with respect to one another. The sleeve 303 may be secured to the gland bolt 304 of cone seal assembly 292 by any convenient means, such as a set screw 305.

Figure 15:
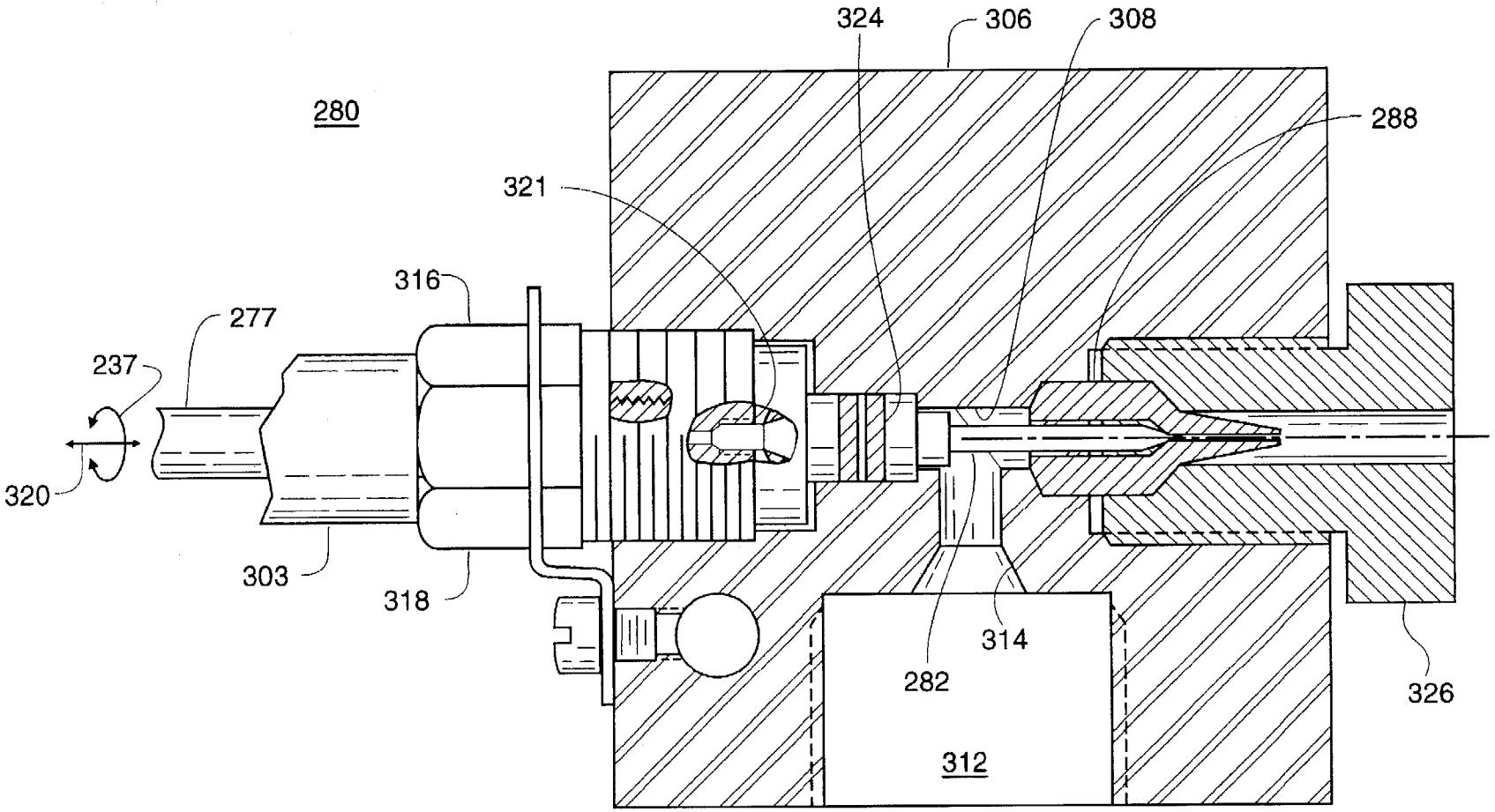
FIG. 15 is a sectional view in elevation of the continuous flow core injection nozzle assembly shown in FIG. 12.

Referring now to FIG. 15, the nozzle housing 280 comprises a main body 306 having a central bore 308 therethrough. Central bore 308 is fluidically connected to a high pressure liquid nitrogen injection chamber 312 by a passage 314. Main body 306 is also adapted to receive mounting assembly 316 which fixedly secures main body 306 to the sleeve 303 mounted to the high pressure rotating coupling assembly 234 (FIG. 14). Sleeve 303 may be fixedly received by gland bolt 318 of mounting assembly 316 by any convenient means, such as a set screw (not shown), in a manner similar to that used to secure sleeve 303 to gland bolt 304 as shown in FIG. 14. Gland bolt 318 is also adapted to threadably receive the elongate tube 277 so that as tube 277 is rotated in the direction indicated by arrows 237 it moves axially toward and away from main body 306 in the direction indicated by arrow 320. The end 321 of elongate tube 277 is also adapted to fixedly receive primary nozzle 282, such that the central bore 278 (FIG. 13) of elongate tube 277 is in fluid communication with the central bore 322 (FIG. 17) of primary nozzle 282. Thus, as elongate tube 277 is rotated by knob 276 (FIG. 13) in the direction of arrows 237, elongate tube 277 and primary nozzle 282 move axially in the direction indicated by arrow 320. Finally, mounting assembly 316 also includes a packing assembly 324 for preventing high pressure liquid nitrogen (not shown) within chamber 312 from leaking past primary nozzle 282.

Figure 16:
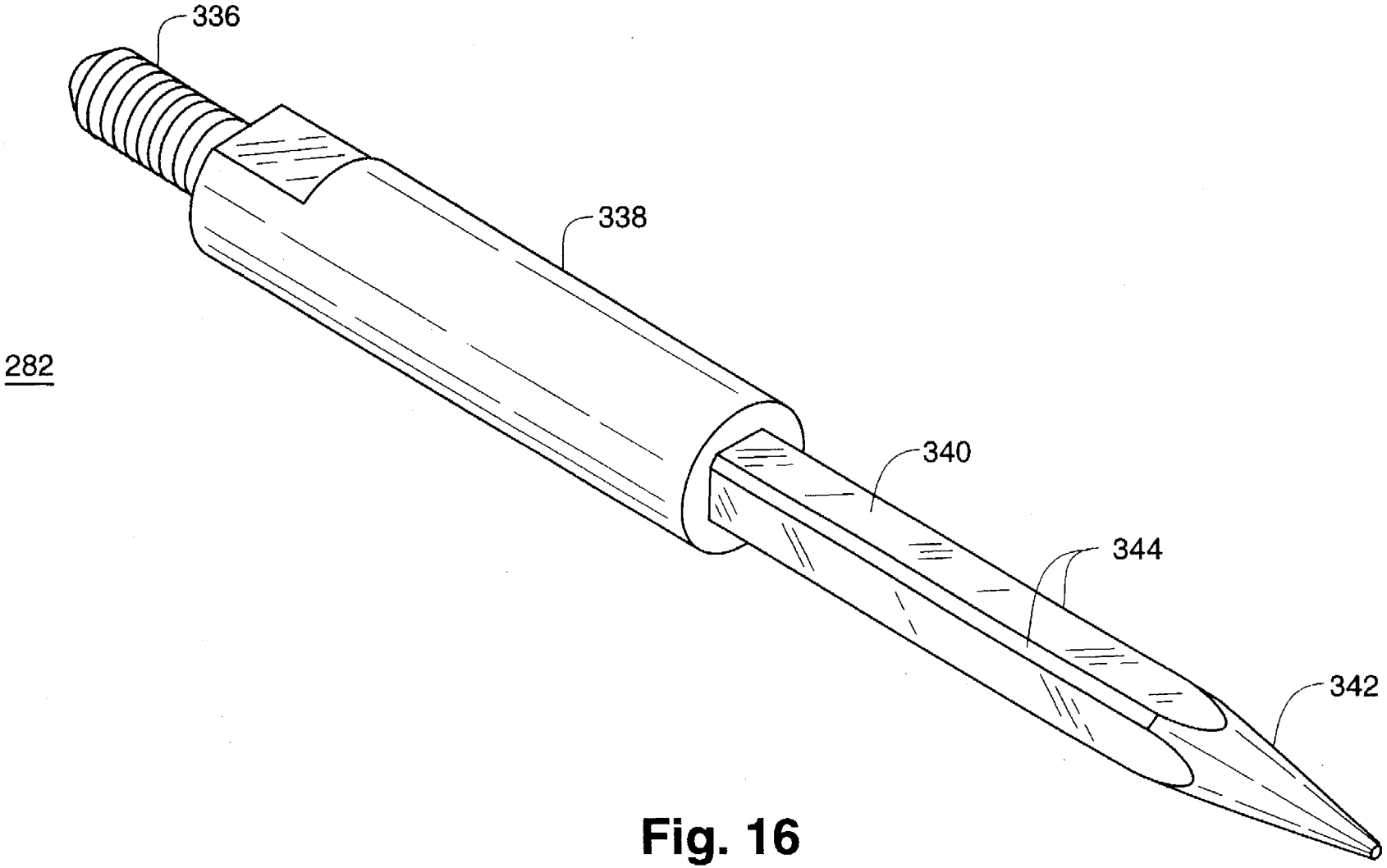
FIG. 16 is an enlarged view in perspective of the primary nozzle of the continuous flow core injection nozzle assembly shown in FIG. 15.

Referring now to FIG. 16, primary nozzle 282 comprises a threaded inlet end 336 adapted to thread into the end 321 of elongate tube 277 as best seen in FIG. 15. Primary nozzle 282 also includes an elongate cylindrical seating surface portion 338 for sealably engaging the packing assembly 324, as is also best seen in FIG. 15. Finally, nozzle 282 also includes an elongate outlet section 340 having a plurality of flutes 344 and a conical end 342. As will be described below, the elongate outlet end section 340 is adapted to be slidably and rotatably received by the elongate inlet passage 328 of secondary nozzle 288.

Figure 17:
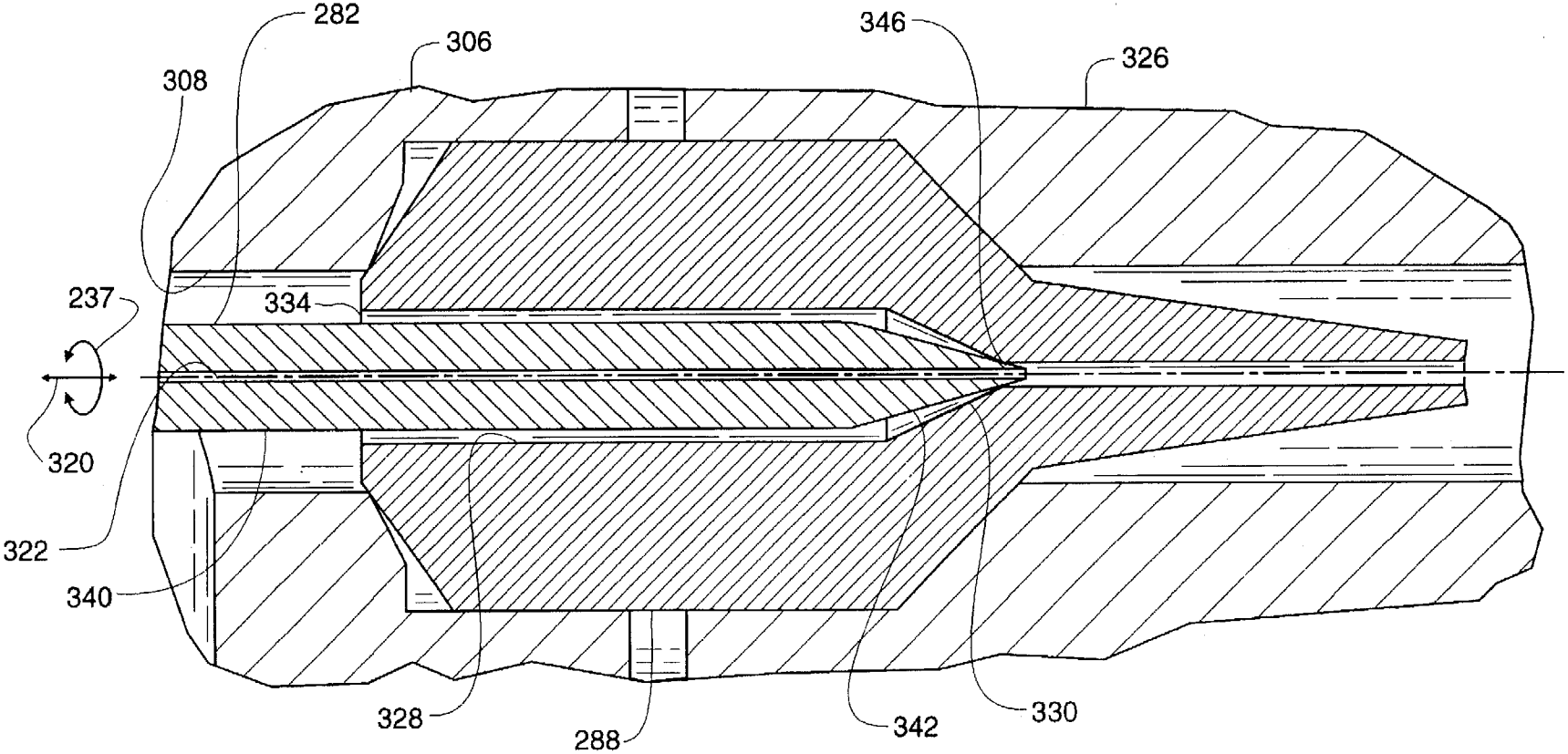
FIG. 17 is an enlarged sectional view in elevation of the primary and secondary nozzles of the continuous flow core injection nozzle assembly shown in FIG. 15.

Referring now to FIGS. 15 and 17 simultaneously, main body 306 is also adapted to receive a secondary nozzle 288 that is retained by a nozzle retaining bolt 326. Secondary nozzle 288 includes an elongate inlet passage 328 terminating in a conical or tapered nozzle inlet 330 and an elongate nozzle outlet 332. Elongate inlet passage 328 and tapered nozzle inlet 330 are adapted to receive the elongate outlet section 340 of primary nozzle 282. The flutes 344 of elongate outlet section 340 contact the elongate inlet passage 328 of secondary nozzle 288, thus supporting the elongate outlet section 340 within the elongate inlet passage 328 while at the same time creating a plurality of passages 344 between the primary nozzle 282 and the elongate inlet passage 328. The flutes 344 allow the primary nozzle 282 to be rotated in the direction of arrows 237 and axially moved in the direction of arrows 320 to change the size of the annular gap 346 between the conical end 342 of primary nozzle 282 and the conical nozzle inlet 330 of secondary nozzle 288, thus change the amount of liquid nitrogen from chamber 312 that is allowed to flow down the annular-like passages 334 and ultimately form the liquid sheath 224 (FIG. 7).

The nozzle housing 280 shown in FIGS. 12 and 15–17 thus produces a dual state stream comprising a central core 222 of slurry 216 and a liquid sheath 224 of liquid nitrogen, which may be desirable for certain applications. In other applications, however, it may be desirable to utilize a tri-state stream 220 (FIG. 7) that includes a gaseous outer jacket 226. If so, the nozzle retaining bolt 326 may be replaced with a base plate and third nozzle assembly 298 similar to the base plate 94 and nozzle 98 shown in FIG. 4, to allow gaseous nitrogen to be introduced into the stream.

Figure 18:
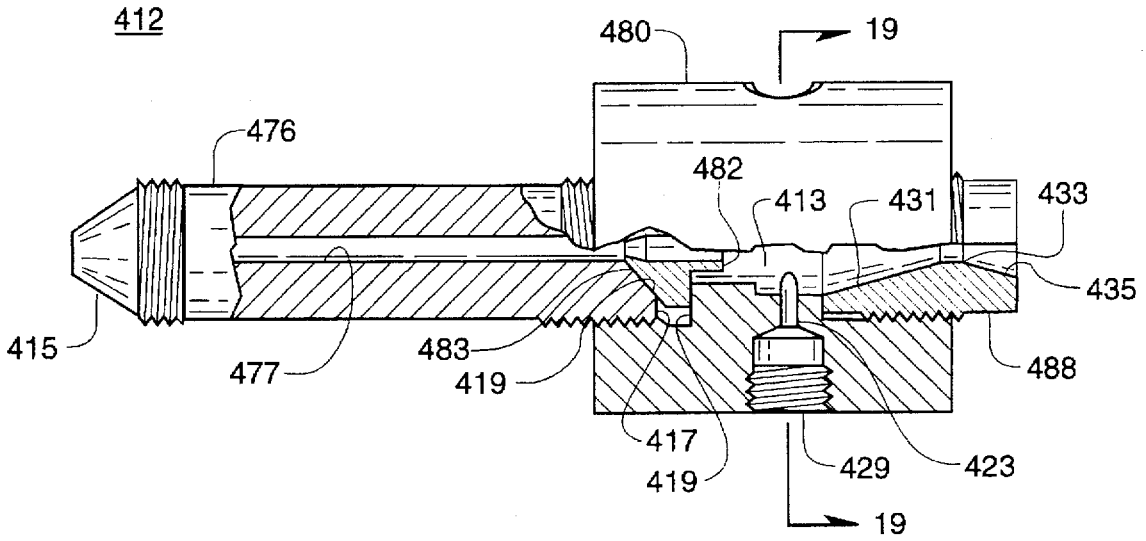
FIG. 18 is a sectional view in elevation of a cyclone mixing nozzle.

A cyclone mixing nozzle assembly 412 is shown in FIG. 18 that may be used to generated a dual-state stream (not shown) or a tri-state stream similar to the tri-state streams 20 and 220 shown in FIGS. 1 and 7, respectively. Briefly, cyclone nozzle assembly 412 may comprise a main body 480 that is adapted to receive a primary nozzle inlet barrel 476. Barrel 476 includes a central bore 477 therethrough for delivering a fluid, either liquid nitrogen (not shown) or slurry 216 (FIG. 11), to a primary nozzle 482. Main body 480 is also adapted to receive a secondary nozzle 488 such that a cyclone mixing chamber 413 is defined between the primary nozzle 482 and the secondary nozzle 488. The streams produced by cyclone mixing nozzle assembly 412 may comprise a central core of liquid nitrogen surrounded by a particle sheath (as was the case for the stream 20 shown in FIG. 1), if liquid nitrogen is injected into barrel 476 and carbon dioxide gas is injected into the mixing chamber 413. Alternatively, the cyclone mixing nozzle assembly 412 may be used to generate a stream having a central core comprising a slurry surrounded by a liquid sheath (as was the case for the stream 220 shown in FIG. 7), if the slurry 216 (FIG. 11) is injected into barrel 476 and liquid nitrogen is injected into the mixing chamber 413.

Referring now specifically to FIG. 18, primary nozzle inlet barrel 476 comprises an elongate, cylindrically-shaped member having an inlet end 415 and an outlet end 417 connected by a central bore 477. Outlet end 417 also includes a conical seat 419 adapted to receive a conical end 483 of primary nozzle 482. In one preferred embodiment, the inlet barrel 476 may be threadably engaged to the main body 480 so that primary nozzle 482 is held tightly between the end 417 of barrel 476 and mounting boss 419 of main body 480.

Figure 19:
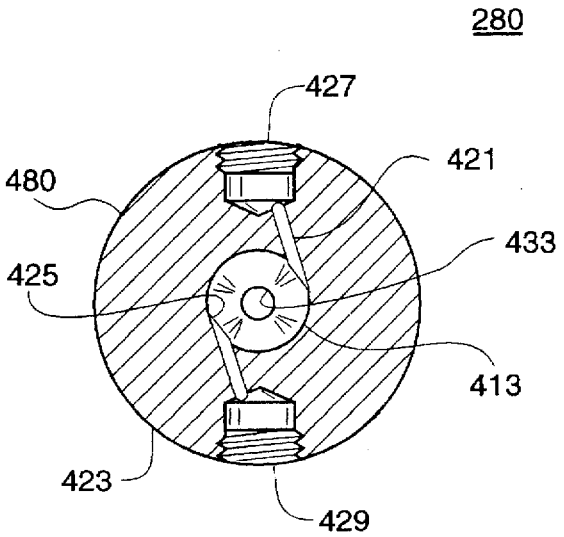
FIG. 19 is a sectional view of the cyclone mixing nozzle taken along the line 19—19 of FIG. 18.

Cyclone mixing chamber 413 comprises a cylindrical chamber having a pair of injection ports 421, 423 oriented transverse to the interior wall 425 of chamber 413. See FIG. 19. Injection ports 421, 423 fluidically connect respective inlets 427, 429 to the cyclone mixing chamber 413. In one preferred embodiment, both injection ports 421, 423 are tangentially oriented to the interior wall 425 of chamber 413 so that fluid (either liquid nitrogen or slurry, depending on the desired application) passing through the ports 421, 423 is injected tangentially into chamber 413 and forms a vortex or cyclone (not shown) around the stream of fluid (also not shown) exiting from the primary nozzle 482.

During operation, a supply of high pressure fluid, such as liquid nitrogen (not shown), connected to the inlet barrel 476 introduces a high pressure flow of liquid nitrogen through the central bore 477. The liquid nitrogen is accelerated by primary nozzle 482 and emerges from the primary nozzle as a high velocity stream. Gaseous carbon dioxide or a particle laden fluid, such as a slurry 216 (FIG. 11) passes through inlets 427 and 429 and is injected into the cyclone mixing chamber 413 via the injection ports 421 and 423 whereupon it forms a vortex or cyclone around the high velocity stream. The central core of liquefied nitrogen and its surrounding jacket of $CO_2$ or slurry then pass into the secondary nozzle 488. The inlet or converging section 431 of nozzle 488 increases the velocity of the fluids and guides the carbon dioxide (or slurry) into intimate contact with the high velocity core of liquid nitrogen. The fluids then pass through throat section 433 and into diverging section 435. The sizes of the converging section 431, throat section 433, and diverging section 435 of nozzle 488 are sized to control the mixing and flow characteristics of the nozzle 412. As was the case for the earlier embodiments, a third nozzle assembly (not shown), similar to nozzle assembly 98 (FIG. 4) may be attached to the secondary nozzle 488 to allow a gaseous outer jacket to be established around the stream.

This completes the detailed description of the preferred embodiments of the cutting and abrading system according to the present invention. While a number of specific components were described above for the preferred embodiments of this invention, persons skilled in this art will readily recognize that other substitute components or combinations of components may be available now or in the future to accomplish functions comparable to those of the apparatus according to this invention. For example, numerous sublimable materials may be used with the present invention depending on the particular application or the desired characteristics of the stream. Likewise, many other configurations for the fluid delivery systems are possible and the invention could be used with any fluid delivery system capable of supplying the various constituent materials to the nozzle assembly at the appropriate pressures. Accordingly, the present invention should not be regarded as limited to the constituent materials and fluid delivery systems shown and described herein.

Other possible substitutes have been mentioned throughout this description, and many more equivalents are possible. For example, the nozzle assemblies 12, 112, 212, and 412 are not limited to the specific structures and configurations shown in the drawings, and several alternative configurations for achieving the same functions would be obvious to persons having ordinary skill in the art after having become familiar with the details of this invention. Therefore, it would be feasible to someone having ordinary skill in the art, in light of this disclosure, to assemble the necessary components to practice this invention, regardless of whether some of such components might not be the same as those described herein.

Consequently, the foregoing is considered illustrative only of the principles of the invention, and all suitable modifications and equivalents may be resorted to as falling within the scope of the invention as defined by the claims which follow.

We claim:

1. Apparatus for cutting and abrading an object, comprising:

first gas delivery means for providing a first gas in a liquid form at a first pressure and for providing the first gas in a gas form at a second pressure;

particle delivery means for providing a slurry at a third pressure, the slurry comprising a second gas in a solid form and the first gas in a liquid form; and nozzle means connected to said first gas delivery means and to said particle delivery means for producing a stream having a central jet comprising the slurry, a liquid sheath surrounding the central jet comprising the first gas in a liquid form, and an outer jacket surrounding the liquid sheath comprising the first gas in a gas form.

2. The apparatus of claim 1, wherein said first gas delivery means includes:

a reservoir containing a supply of said first gas in liquid form;

a first pump connected to said reservoir for pressurizing said first gas in liquid form to a fourth pressure;

a second pump connected to said first pump for increasing the pressure of said first gas in liquid form to a fifth pressure;

vaporizing means connected to said second pump for vaporizing said first gas in liquid form to produce a vaporized first gas;

pressure regulating means connected to said vaporizing means for maintaining the vaporized first gas at the second pressure;

a third pump connected to said second pump for increasing the pressure of said first gas in liquid form to a sixth pressure, the sixth pressure being sufficient to vaporize said first gas;

condensing means connected to said second pump for liquefying the vaporized first gas from said third pump.

3. The apparatus of claim 2, wherein said particle delivery means comprises:

a reservoir for holding a supply of the first liquefied gas at a first temperature;

a second gas delivery means for providing a second gas in a gas form at a seventh pressure, said second gas freezing at a temperature that is greater than the first temperature of the first gas;

a pressure vessel partially submerged within the supply of first liquefied gas contained within said reservoir, said pressure vessel having an inlet nozzle connected to said second gas delivery means, a liquefied gas inlet port connected to said first pump; and an outlet, wherein the second gas in a gas form flowing through said inlet nozzle freezes into particles upon contact with the first gas in a liquid form and wherein frozen particles of said second gas and the first gas in a liquid form are removed from said pressure vessel through said outlet as a slurry.

4. The apparatus of claim 3, wherein the first gas comprises nitrogen.

5. The apparatus of claim 4, wherein the second gas comprises carbon dioxide.

6. The apparatus of claim 5, wherein the first pressure is in the range of about 4,000 to 75,000 pounds per square inch gauge and wherein the second pressure is in the range of about 20 to 15,000 pounds per square inch gauge.

7. The apparatus of claim 6, wherein the seventh pressure is in the range of about 1,000 to 2,000 pounds per square inch gauge.

8. The apparatus of claim 7, further comprising collection means surrounding said nozzle means and the object for collecting particles abraded from the object.

9. The apparatus of claim 1, wherein said nozzle means comprises:

an elongate first nozzle having an inlet end and an outlet end oriented along a flow axis, said elongate first nozzle also having a tapered end at the outlet end, the inlet end of said elongate first nozzle being adapted to receive the slurry from said particle delivery means;

a second nozzle having an elongate inlet passage, a converging inlet end, and an outlet end oriented along the flow axis, the elongate inlet passage being adapted to receive a portion of said elongate first nozzle so that an elongate annular passage is created between the inlet of said second nozzle and said elongate first nozzle and so that the tapered end of said elongate first nozzle is aligned with the converging inlet end of said second nozzle, the location of the tapered end of said elongate first nozzle and the converging inlet end of said second nozzle such that an annular gap exists between the tapered end of said elongate first nozzle and the converging inlet end of said second nozzle, the inlet end of said second nozzle being adapted to receive the first gas in a liquid form from said first gas delivery means;

means for moving said elongate first nozzle along the flow axis and with respect to said second nozzle so that the tapered end can be moved toward and away from the converging inlet end of said second nozzle to decrease and increase the annular gap between the tapered end of said first nozzle and the converging inlet end of said second nozzle; and a third nozzle having an inlet end and an outlet end aligned along the flow axis and positioned in spaced-apart relation to said second nozzle so that a second gap is formed between the outlet end of said second nozzle and the inlet end of said third nozzle, the inlet end of said third nozzle being adapted to receive the first gas in a gas form from said first gas delivery means.

10. Apparatus for cutting an abrading an object, comprising:

a cyclone mixing chamber having an inlet end and an outlet end oriented along a flow axis and having a central bore therethrough, the central bore of said cyclone mixing chamber being surrounded by a continuous side wall having an interior surface, said cyclone mixing chamber also including an injection port transverse to the central bore;

a first nozzle having an inlet end and an outlet end oriented along the flow axis and positioned with respect to said cyclone mixing chamber so that the outlet end of said first nozzle is adjacent the inlet end of said cyclone mixing chamber;

a second nozzle having an inlet end and an outlet end oriented along the flow axis and positioned with respect to said cyclone mixing chamber so that the inlet end of said second nozzle is adjacent the outlet end of said cyclone mixing chamber;

first delivery means for introducing a liquefied gas into the inlet end of said first nozzle; and second delivery means for introducing a slurry into the injection port of said cyclone mixing chamber.

11. The apparatus of claim 10, further comprising:

a third nozzle having an inlet end and an outlet end aligned along the flow axis and positioned in spaced-apart relation to said second nozzle so that a second gap is formed between the outlet end of said second nozzle and the inlet end of said third nozzle; and third delivery means for introducing a gas into the second gap.

12. The apparatus of claim 11, wherein said cyclone mixing chamber comprises a cylindrical chamber and wherein the injection port is oriented tangentially to the cylindrical chamber so that said slurry forms a vortex when injected through the injection port and into the cylindrical chamber.

13. Apparatus for cutting and abrading an object, comprising:

an elongate first nozzle having an inlet end and an outlet end oriented along a flow axis, said elongate first nozzle also having a tapered end at the outlet end;

a second nozzle having an elongate inlet passage, a converging inlet end, and an outlet end oriented along the flow axis, the elongate inlet passage being adapted to receive a portion of said elongate first nozzle so that an elongate annular passage is created between the inlet of said second nozzle and said elongate first nozzle and so that the tapered end of said elongate first nozzle is aligned with the converging inlet end of said second nozzle, the location of the tapered end of said elongate first nozzle and the converging inlet end of said second nozzle such that an annular gap exists between the tapered end of said elongate first nozzle and the converging inlet end of said second nozzle;

first delivery means for introducing a liquefied gas into the inlet end of said first nozzle; and second delivery means for introducing a slurry into the elongate annular passage between said elongate first nozzle and the elongate passage of said second nozzle.

14. The apparatus of claim 13, further comprising:

means for moving said elongate first nozzle along the flow axis and with respect to said second nozzle so that the tapered end can be moved toward and away from the converging inlet end of said second nozzle to decrease and increase the annular gap between the tapered end of said first nozzle and the converging inlet end of said second nozzle.

15. The apparatus of claim 14, further comprising:

a third nozzle having an inlet end and an outlet end aligned along the flow axis and positioned in spaced-apart relation to said second nozzle so that a second gap is formed between the outlet end of said second nozzle and the inlet end of said third nozzle; and third delivery means for introducing a gas into the second gap.

16. A nozzle assembly, comprising:

a cyclone mixing chamber having an inlet end and an outlet end oriented along a flow axis and having a central bore therethrough, the central bore of said cyclone mixing chamber being surrounded by a continuous side wall having an interior surface, said cyclone mixing chamber also including an injection port transverse to the central bore;

a first nozzle having an inlet end and an outlet end oriented along the flow axis and positioned with respect to said cyclone mixing chamber so that the outlet end of said first nozzle is adjacent the inlet end of said cyclone mixing chamber; and a second nozzle having an inlet end and an outlet end oriented along the flow axis and positioned with respect to said cyclone mixing chamber so that the inlet end of said second nozzle is adjacent the outlet end of said cyclone mixing chamber.

17. The nozzle assembly of claim 16, further comprising a third nozzle having an inlet end and an outlet end aligned along the flow axis and positioned in spaced-apart relation to said second nozzle so that a second gap is formed between the outlet end of said second nozzle and the inlet end of said third nozzle.

18. The nozzle assembly of claim 17, wherein said cyclone mixing chamber comprises a cylindrical chamber and wherein the injection port is oriented tangentially to the cylindrical chamber.

19. A nozzle assembly, comprising:

an elongate first nozzle having an inlet end and an outlet end oriented along a flow axis, said elongate first nozzle also having a tapered end at the outlet end;

a second nozzle having an elongate inlet passage, a converging inlet end, and an outlet end oriented along the flow axis, the elongate inlet passage being adapted to receive a portion of said elongate first nozzle so that an elongate annular passage is created between the inlet of said second nozzle and said elongate first nozzle and so that the tapered end of said elongate first nozzle is aligned with the converging inlet end of said second nozzle, the location of the tapered end of said elongate first nozzle and the converging inlet end of said second nozzle such that an annular gap exists between the tapered end of said elongate first nozzle and the converging inlet end of said second nozzle.

20. The nozzle assembly of claim 19, further comprising:

means for moving said elongate first nozzle along the flow axis and with respect to said second nozzle so that the tapered end can be moved toward and away from the converging inlet end of said second nozzle to decrease and increase the annular gap between the tapered end of said first nozzle and the converging inlet end of said second nozzle.

21. The nozzle assembly of claim 20, further comprising:

a third nozzle having an inlet end and an outlet end aligned along the flow axis and positioned in spaced-apart relation to said second nozzle so that a second gap is formed between the outlet end of said second nozzle and the inlet end of said third nozzle.

22. A rotatable fluid coupling, comprising:

a main body having a first end and a second end and having a central bore therethrough extending from the first end to the second end, said main body also having an injection chamber disposed therein adapted to receive a supply of a fluid, wherein the injection chamber is in fluid communication with the central bore;

an elongate tube having a central bore therethrough, said elongate tube also having a transverse bore therethrough intersecting said central bore, said elongate tube being sized to be received by the central bore of said main body so that the transverse bore of said elongate tube is in fluid communication with the injection chamber of said main body, wherein the fluid contained with the injection chamber flows through the transverse bore in said elongate tube and into the central bore of said elongate tube; and first and second sealing means mounted to the first and second ends of said main body, respectively, and rotatably sealably associated with the central bore in said main body and said elongate tube for preventing the fluid within the injection chamber from leaking past said elongate tube.

23. The rotatable coupling of claim 22, wherein each of said first and second sealing means comprises:

a cone seal having a flat end and a conical end and having a central bore therethrough, the conical end being adapted to be received by a mating conical seat within said main body; and a gland bolt threadably engaged within said main body and adapted to engage the flat end of said cone seal, said gland bolt urging said cone seal toward the mating conical seat within said main body, wherein the conical end of said cone seal sealably engages the mating conical seat.

24. The rotatable coupling of claim 23, further comprising a belleville washer positioned between said gland bolt and the flat end of said cone seal.

25. A particle generator, comprising:

a reservoir for holding a supply of a first liquefied gas at a first temperature;

a pressure vessel partially submerged within the supply of first liquefied gas contained within said reservoir, said pressure vessel having an inlet nozzle, a liquefied gas inlet port, and an outlet;

means for introducing a second gas into the inlet nozzle, said second gas freezing at a second temperature that is greater than the first temperature of the first liquefied gas; and means for introducing the first liquefied gas at the first temperature into said liquefied gas inlet port, wherein the second gas flowing through said inlet nozzle freezes into particles upon contact with the first liquefied gas and wherein frozen particles of said second gas and the first liquefied gas are removed from said pressure vessel through said outlet as a slurry.

26. The particle generator of claim 25, wherein said liquefied gas inlet port is adapted to introduce the first liquefied gas into said pressure vessel tangentially, said first liquefied gas forming a vortex within said pressure vessel.

27. A pressurization system for pressurizing a first liquefied gas to extreme pressure, comprising:

a first reciprocating high pressure pump having a pair of inlets and a pair of outlets, said first pump alternately discharging the first liquefied gas through alternating ones of the pair of outlets;

a second reciprocating high pressure pump having a pair of inlets and a pair of outlets, said second pump alternately discharging the first liquefied gas through alternating ones of the pair of outlets, the pair of outlets of said second pump being fluidically connected to the pair of outlets of said first pump and discharging into a common outlet;

means for actuating said first and second reciprocating pumps so that said first reciprocating high pressure pump is placed in a stalled mode and said second reciprocating high pressure pump is placed in a catch-up mode if a pressure of said liquefied gas at either of the outlets of said first pump exceeds a predetermined pressure and so that said first reciprocating high pressure pump is placed in a catch-up mode and said second reciprocating high pressure pump is placed in a stalled mode if the pressure of said liquefied gas at either of the outlets of said second pump exceeds the predetermined pressure, wherein the pressure of said liquefied gas at the outlets of said first and second high pressure reciprocating pumps remains substantially constant.

28. A method for producing a particle stream, comprising the steps of:

creating a high velocity jet of slurry by passing a slurry through a first nozzle;

directing the high velocity jet of slurry through a second nozzle, said second nozzle having an inlet therein;

passing a liquefied gas through said inlet in said second nozzle so that said liquefied gas comes in contact with said high velocity jet of slurry, the liquefied gas forming a liquid sheath adjacent the high velocity jet of slurry.

29. The method of claim 28, further comprising the steps of:

directing the high velocity jet of slurry and liquid sheath from said second nozzle into a third nozzle, said third nozzle having an inlet therein; and passing a supply of gas in vapor form through said inlet in said third nozzle so that said gas in vapor form flows around said liquid sheath in order to form a jacket around said liquid sheath.

* * * * *